US008864409B2

(12) United States Patent
Parker

(10) Patent No.: US 8,864,409 B2
(45) Date of Patent: Oct. 21, 2014

(54) METHOD OF FORMING AN INLAID PATTERN IN AN ASPHALT SURFACE FROM PREFORMED TEMPLATE ISOMETRIES

(71) Applicant: Andrew Jared Parker, Jamestown, NC (US)

(72) Inventor: Andrew Jared Parker, Jamestown, NC (US)

(73) Assignee: Flint Trading, Inc, Thomasville, NC (US)

( * ) Notice: Subject to any disclaimer, the term of this patent is extended or adjusted under 35 U.S.C. 154(b) by 24 days.

(21) Appl. No.: 13/713,188

(22) Filed: Dec. 13, 2012

(65) Prior Publication Data

US 2014/0169880 A1 Jun. 19, 2014

(51) Int. Cl.
*E01C 19/43* (2006.01)

(52) U.S. Cl.
CPC ..... *E01C 19/43* (2013.01)
USPC ..... 404/75; 404/93

(58) Field of Classification Search
CPC ..... E01C 19/43
USPC ..... 404/73–75, 77, 79, 93–95; 427/272; 249/188, 203
See application file for complete search history.

(56) References Cited

U.S. PATENT DOCUMENTS

| | | | |
|---|---|---|---|
| 1,063,752 | A | 6/1913 | Walling |
| 1,950,163 | A | 3/1934 | Farasey |
| 2,196,890 | A | 4/1940 | Bensen |
| 2,237,152 | A | 4/1941 | Larmour |
| 2,595,142 | A | 4/1952 | Herck |
| 2,866,992 | A | 1/1959 | Toulmin, Jr. |
| 2,898,825 | A | 8/1959 | Walket et al. |
| 3,410,185 | A | 11/1968 | Harrington |
| 3,664,242 | A | 5/1972 | Harrington et al. |
| 3,832,079 | A | 8/1974 | Moorhead |
| 3,874,806 | A | 4/1975 | Grist et al. |
| 3,910,711 | A | 10/1975 | Moorhead |
| 4,082,587 | A | 4/1978 | Eigenmann |
| 4,105,354 | A | 8/1978 | Bowman |

(Continued)

FOREIGN PATENT DOCUMENTS

WO 03048458 6/2003

OTHER PUBLICATIONS

Flint Trading, Inc., TrafficScapes Surface Systems for Enhanced Safety, webpage, http://www.flinttrading.com/getdoc/76a7c2df-e03e-47ce-a3ba-f151e1686a40/TrafficScapes-Home.aspx.

(Continued)

*Primary Examiner* — Raymond W Addie
(74) *Attorney, Agent, or Firm* — Guerry L. Grune; aPatentManager

(57) ABSTRACT

This application relates to a method of forming multiple inlaid patterns to complete a final predetermined rotational pattern onto or into a pavement surface. The pattern may be selected for functional or decorative purposes. In one embodiment the method includes the steps of providing a first template created of multiple blocks with portions of rotational isometric patterns having a predetermined pattern; impressing the first template into the pavement surface when the pavement surface is in a pliable state forming an impression therein; removing the first template from the pavement surface exposing the impression; providing a grid having a predetermined pattern matching the pattern of the first template; inserting the grid into the impression; and fixing the grid in position within the impression to form the inlaid pattern thereby creating multiple blocks of said portions of said patterns such that rotational isometric patterns form a final rotational predetermined isometric patterned preform.

34 Claims, 27 Drawing Sheets

(56) References Cited

U.S. PATENT DOCUMENTS

| | | | |
|---|---|---|---|
| 4,135,840 | A | 1/1979 | Puccini et al. |
| 4,376,007 | A | 3/1983 | Eigenmann |
| 4,685,824 | A | 8/1987 | Eigenmann |
| 4,776,723 | A | 10/1988 | Brimo |
| 4,792,259 | A | 12/1988 | Eigenmann |
| 4,854,771 | A | 8/1989 | Corbin et al. |
| 4,889,666 | A | 12/1989 | Kawasaki |
| 5,033,906 | A | 7/1991 | Jordan |
| 5,133,621 | A | 7/1992 | Gonzales |
| 5,215,402 | A | 6/1993 | Stowell et al. |
| 5,421,670 | A | 6/1995 | Meirick |
| 5,447,752 | A | 9/1995 | Cobb |
| 5,487,526 | A | 1/1996 | Hupp |
| 5,494,372 | A | 2/1996 | Oliver et al. |
| 5,502,941 | A | 4/1996 | Zember et al. |
| 5,560,734 | A | 10/1996 | McIntosh et al. |
| 5,653,552 | A | 8/1997 | Wiley et al. |
| 5,792,511 | A | 8/1998 | Oliver et al. |
| 5,857,453 | A | 1/1999 | Caven et al. |
| 6,024,511 | A | 2/2000 | Ross |
| 6,213,680 | B1 | 4/2001 | Schaeffer et al. |
| 6,217,254 | B1 | 4/2001 | Wallgren et al. |
| 6,227,454 | B1 | 5/2001 | Wolf et al. |
| 6,303,058 | B1 | 10/2001 | Kelley et al. |
| 6,382,871 | B1 | 5/2002 | Ross |
| 6,503,558 | B2 | 1/2003 | Williamson |
| 6,595,768 | B1 * | 7/2003 | Hunsaker ..... 425/385 |
| 6,998,010 | B2 | 2/2006 | Wiley |
| 7,000,884 | B2 * | 2/2006 | Bucknell ..... 249/2 |
| 7,066,680 | B2 | 6/2006 | Wiley |
| 8,119,202 | B2 | 2/2012 | Wiley |
| 8,133,540 | B2 | 3/2012 | Wiley et al. |
| 2005/0089372 | A1 | 4/2005 | Wiley |
| 2006/0070698 | A1 | 4/2006 | Wiley |

OTHER PUBLICATIONS

Flint Trading, Inc., TrafficScapes, brochure, http://www.flinttrading.com/getdoc/d589b1ef-7609-43bf-8df9-c1fde537913d/Brochure_DuraTherm_01-01-12_WEB.aspx.

Flint Trading, Inc., Traffic Patterns, A TrafficScapes Solution by Flint, webpage, http://www.flinttrading.com/products/trafficpatterns/trafficpatterns.aspx#tab3.

Flint Trading, Inc., DuraTherm, A TrafficScapes Solution by Flint, webpage, http://www.flinttrading.com/getdoc/d849c5d6-f551-4669-a81c-7790f490e5bd/DuraTherm.aspx#tab3.

* cited by examiner

FIG. 1 – Prior Art

FIG. 2 – Prior Art

QII-L1-R*: QII-L2-R*: QII-L3-R*: QII-L4-R*;

QIII-L1-R*: QIII-L2-R*: QIII-L3-R*: QIII-L4-R*;

QIV-L1-R*: QIV-L2-R*: QIV-L3-R*: QIV-L4-R*.

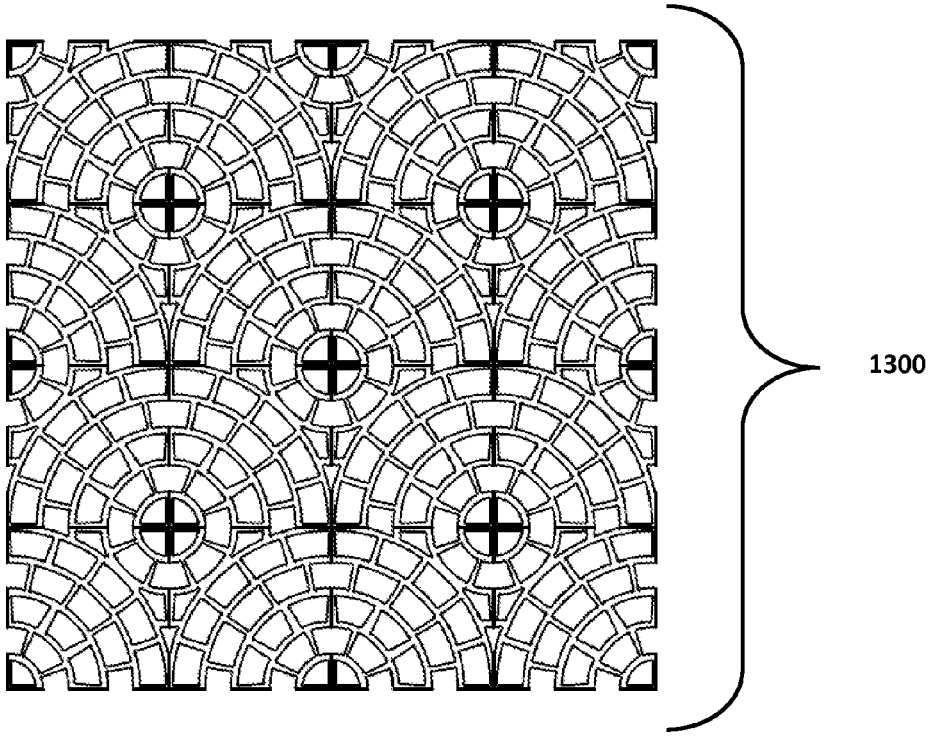
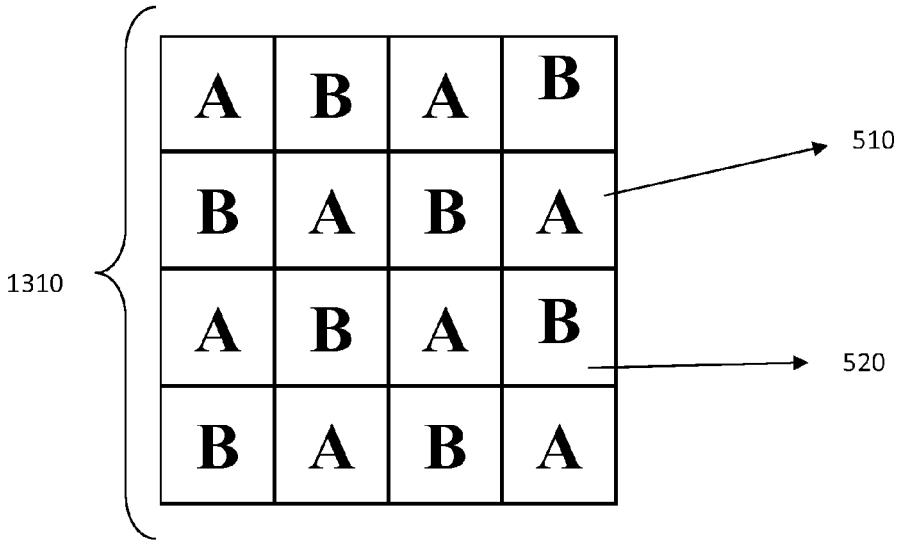
FIG. 11

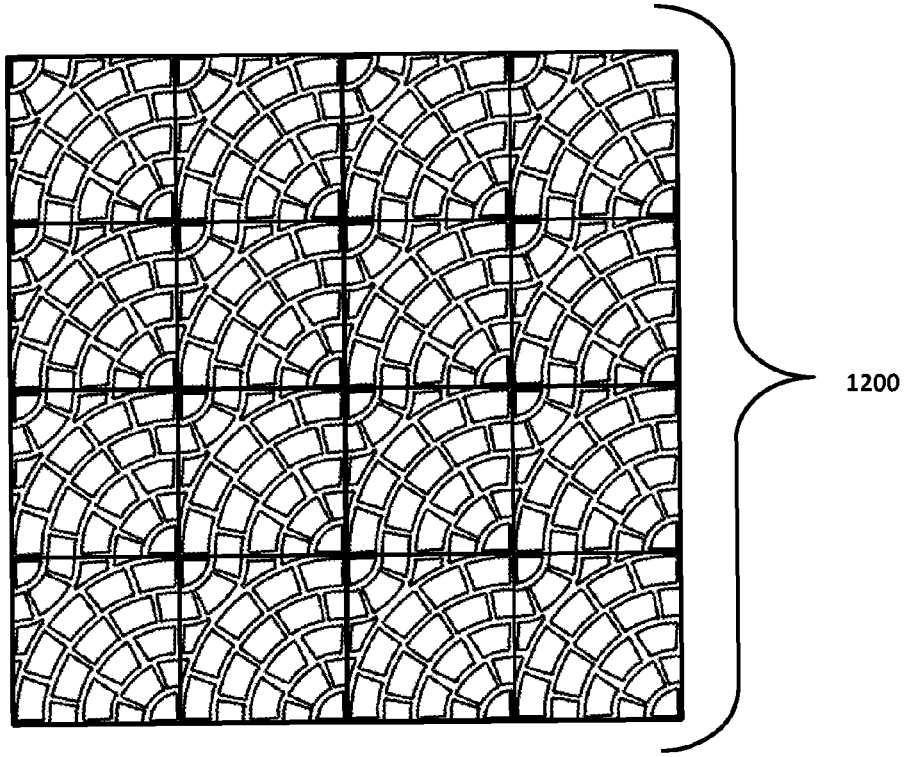
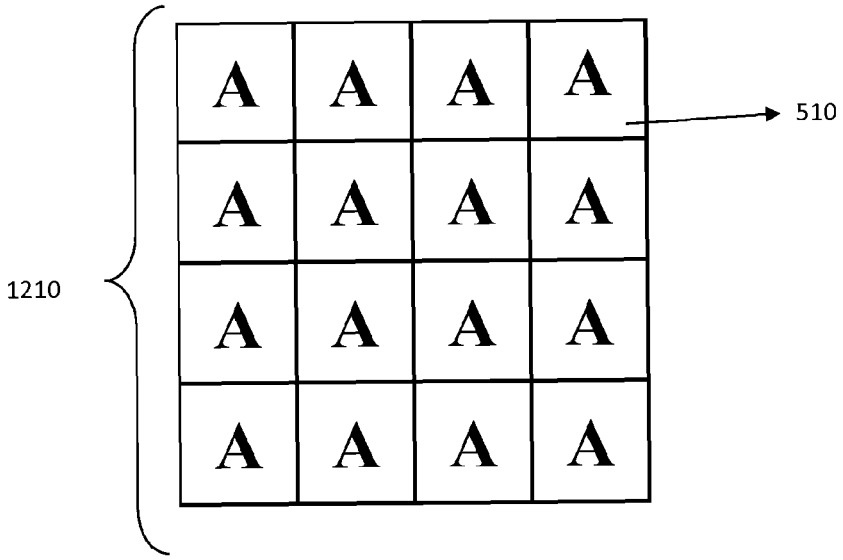
FIG. 12

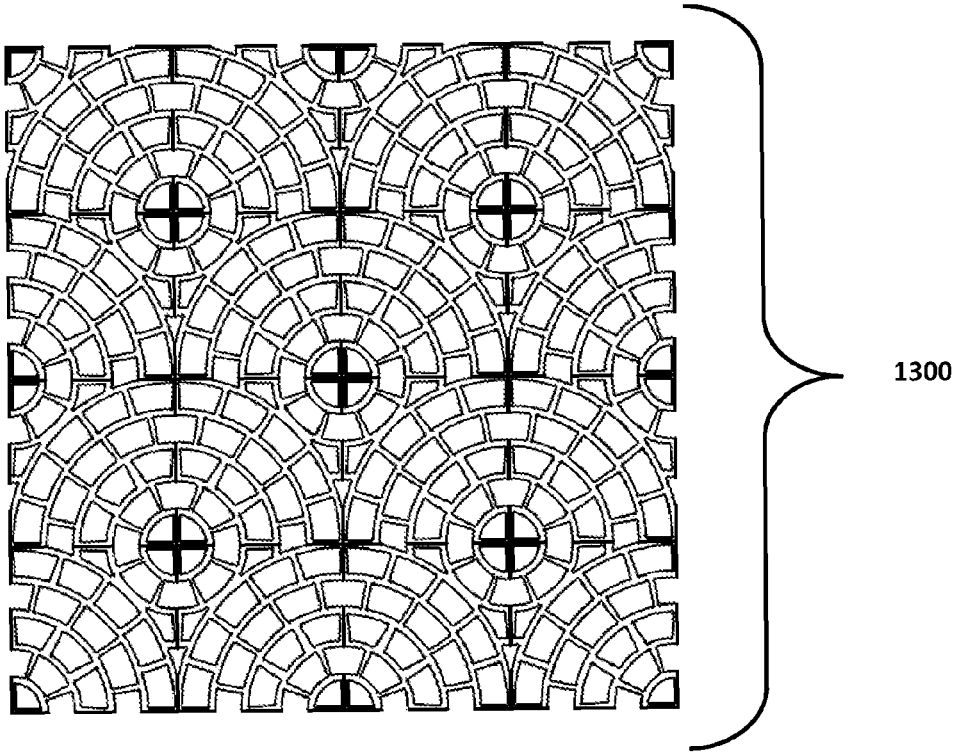
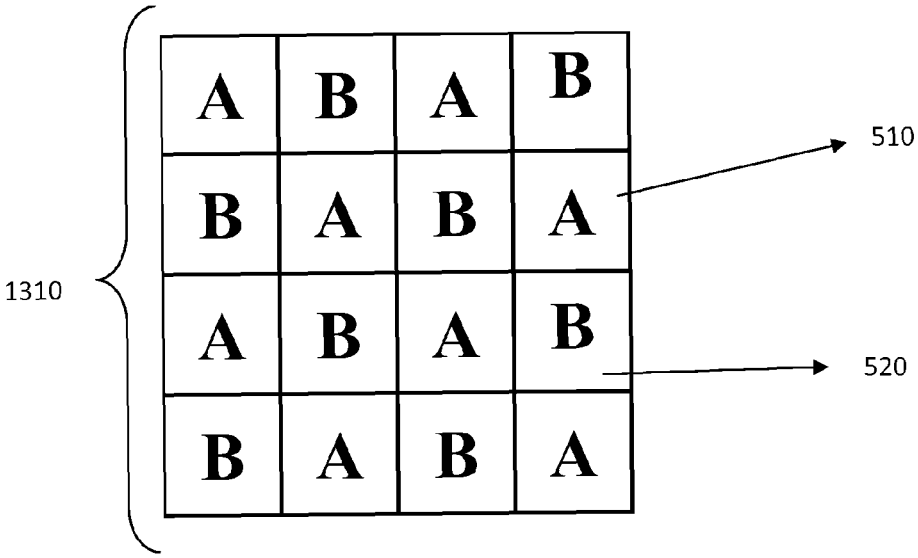
FIG. 13

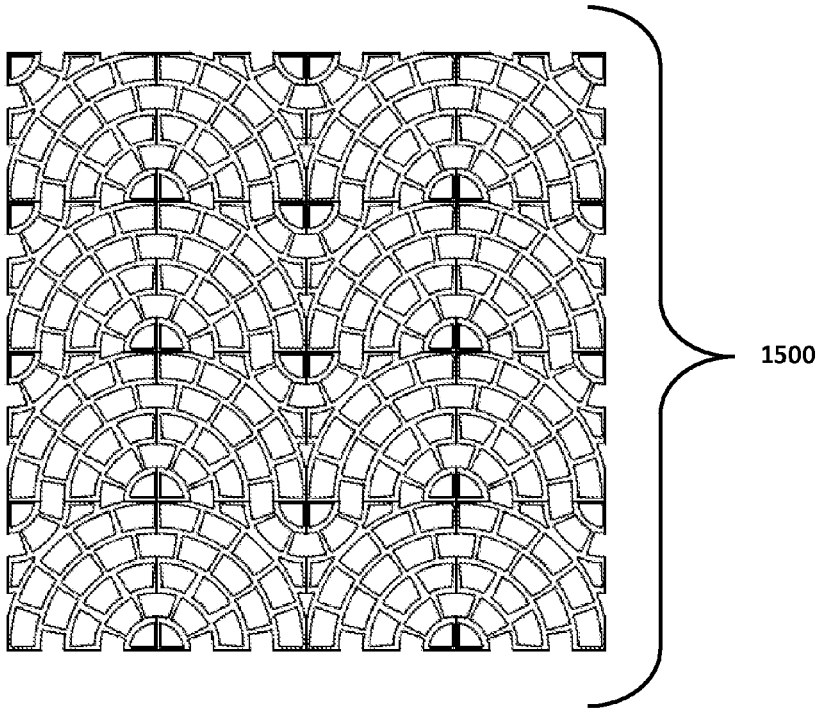
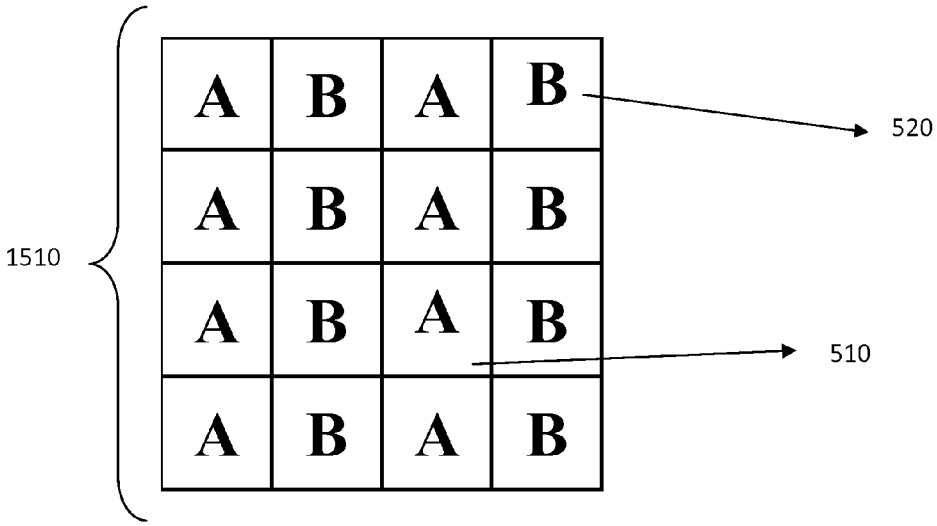
FIG. 15

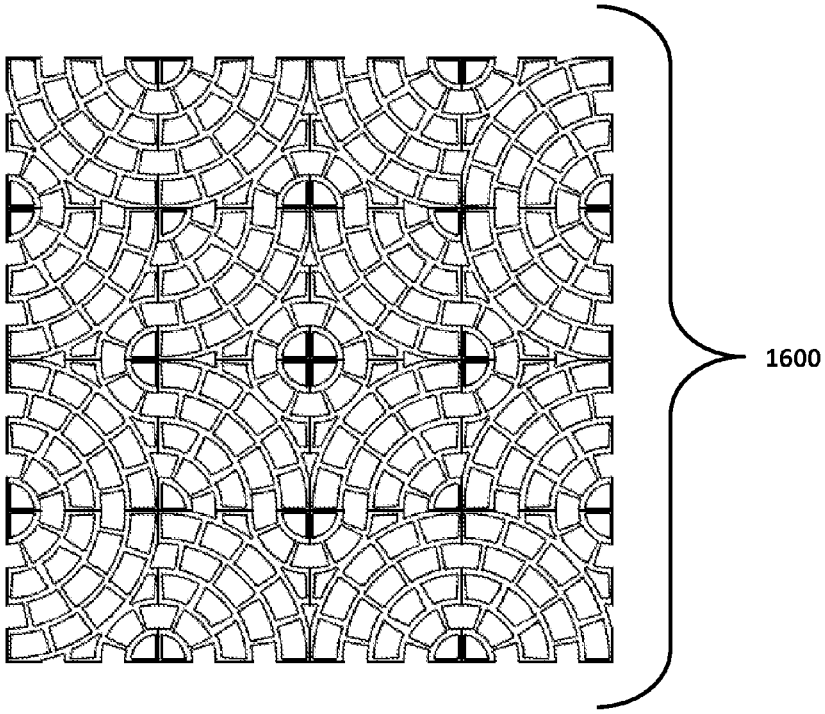
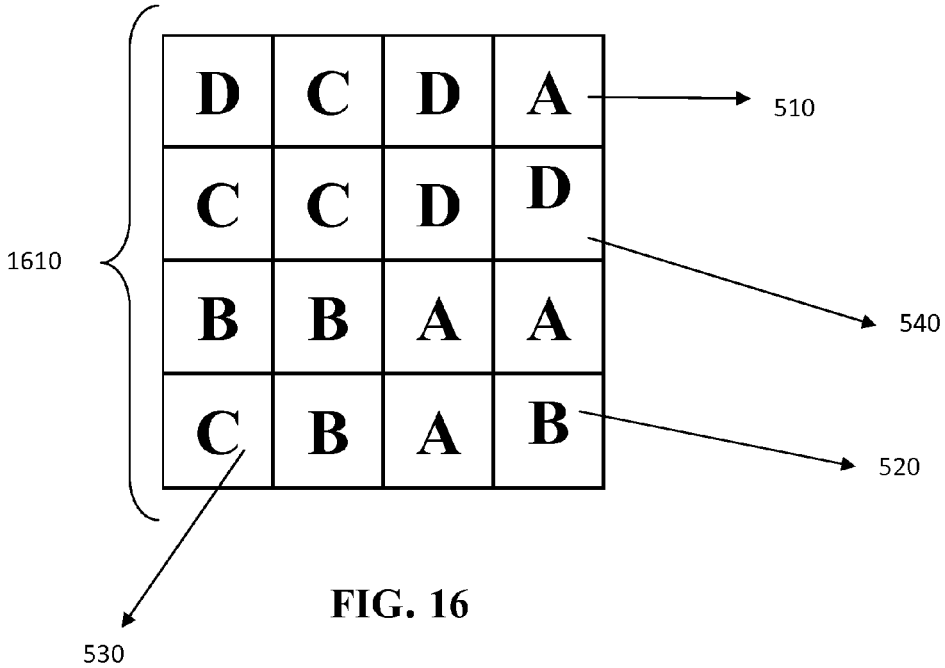
FIG. 16

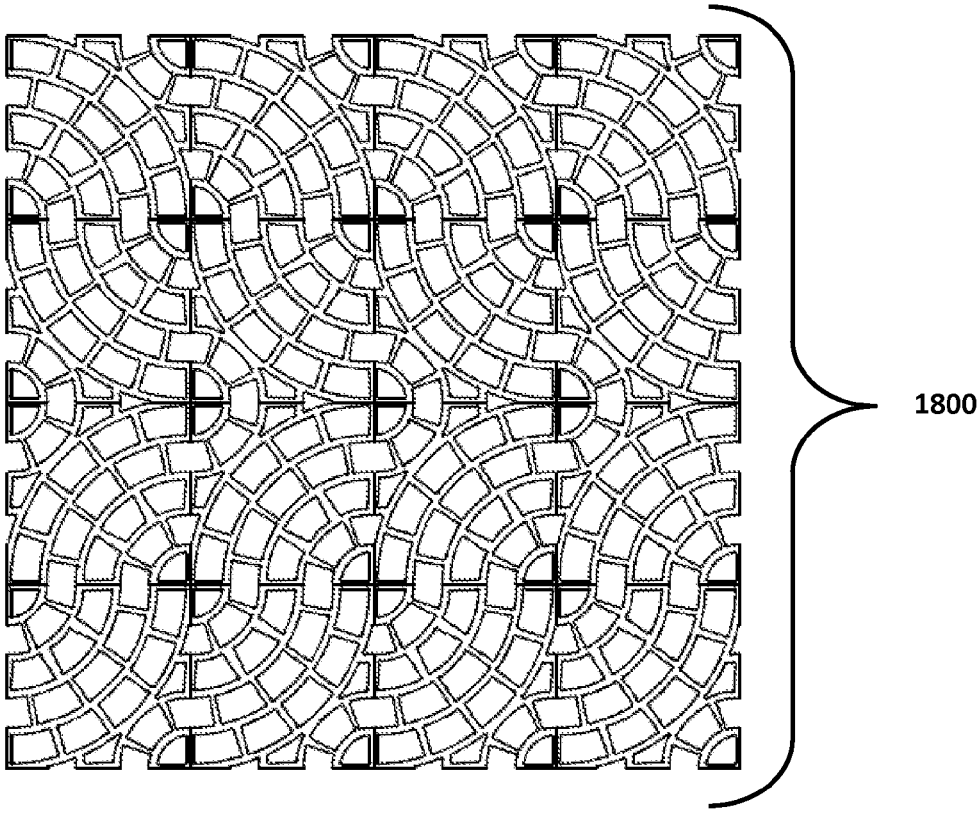
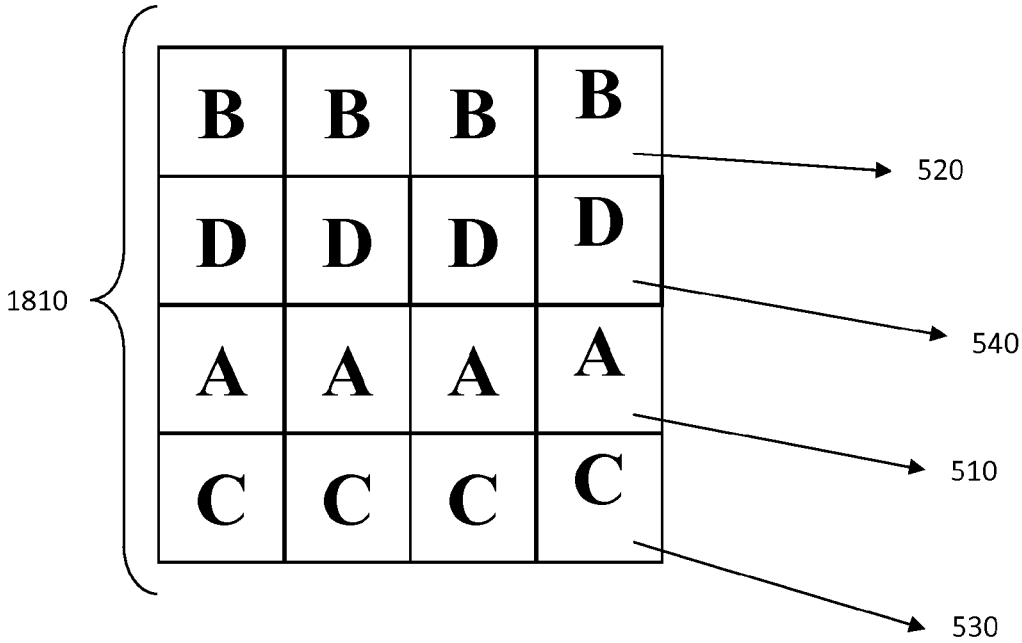
FIG. 18

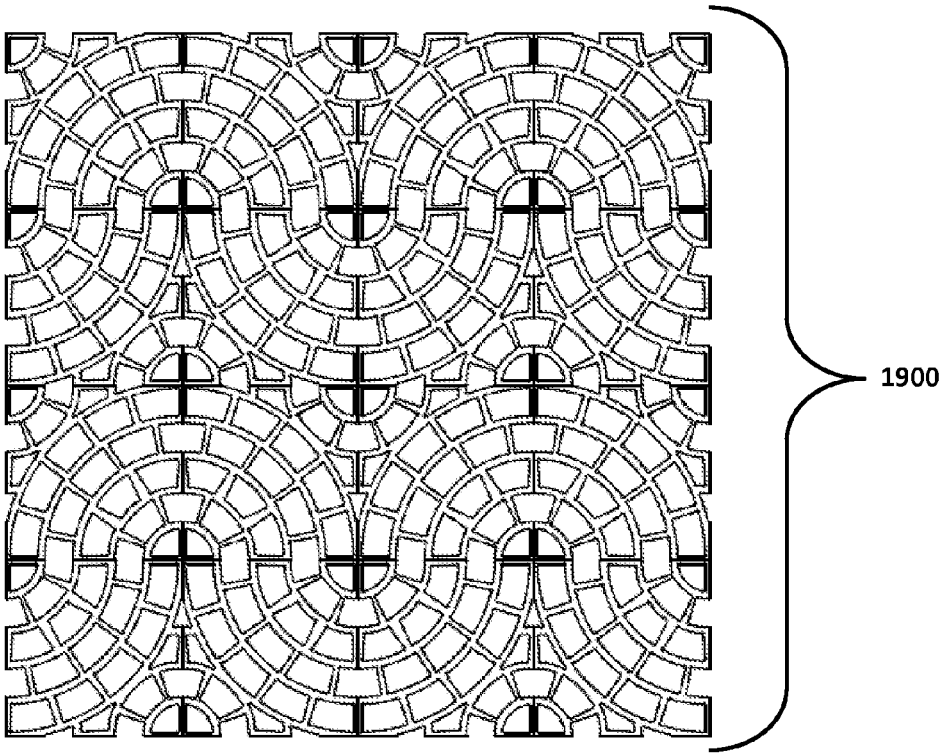
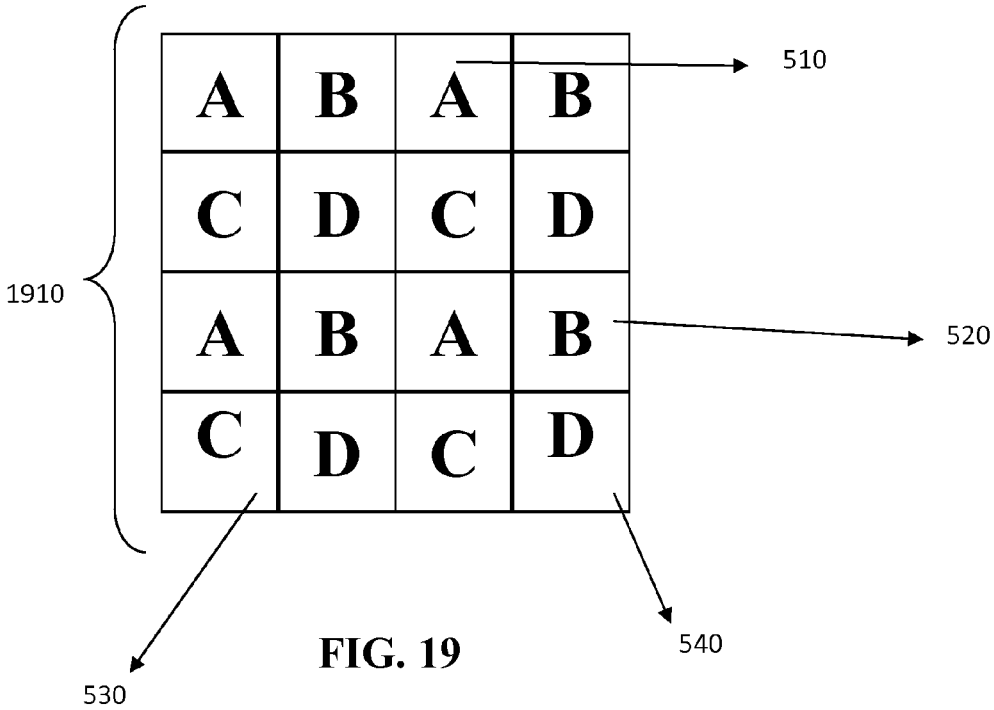
FIG. 19

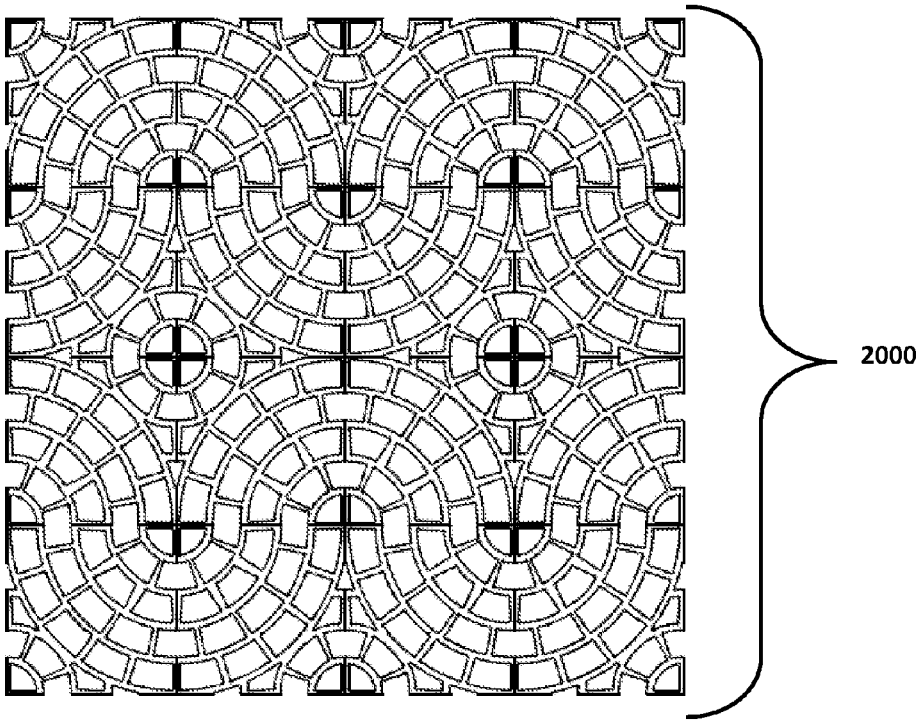
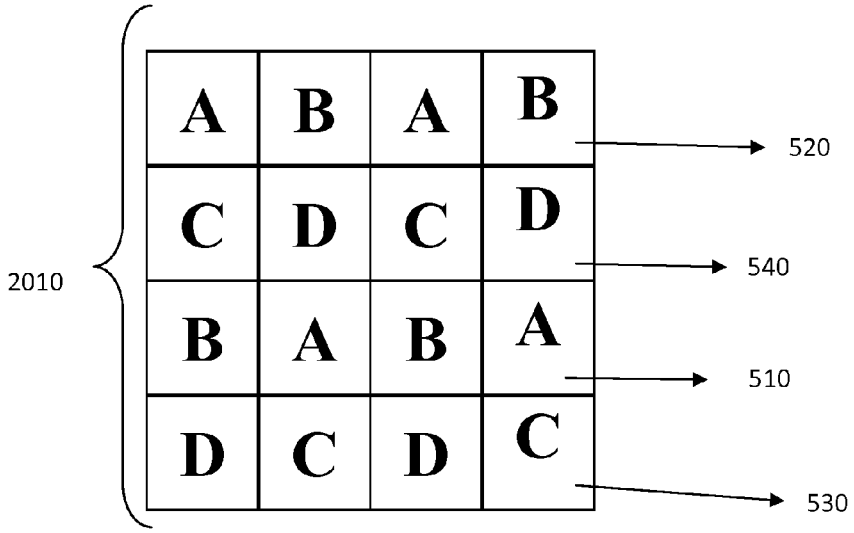
FIG. 20

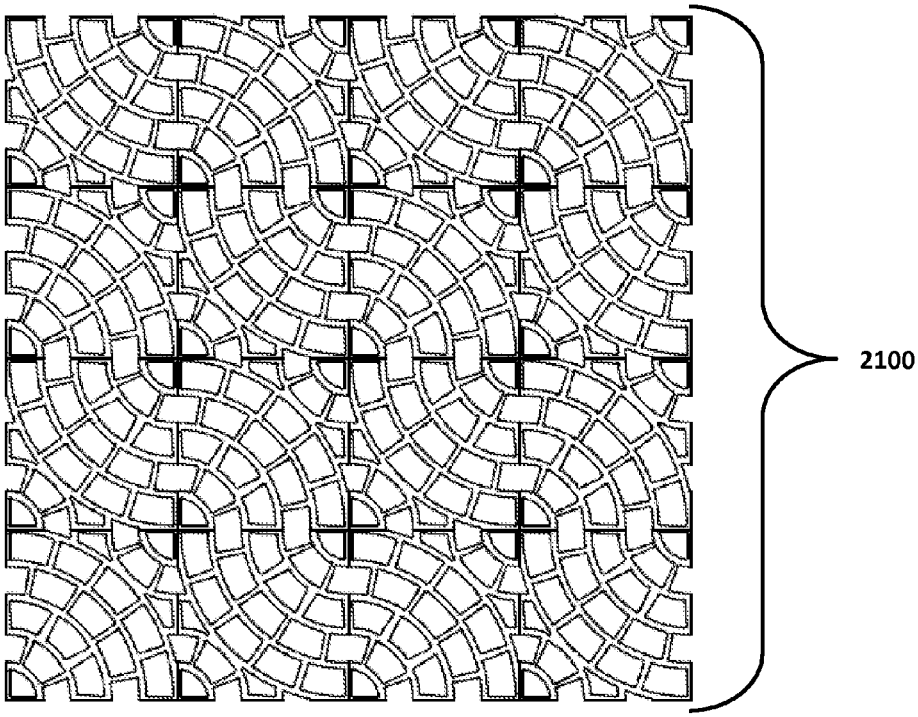
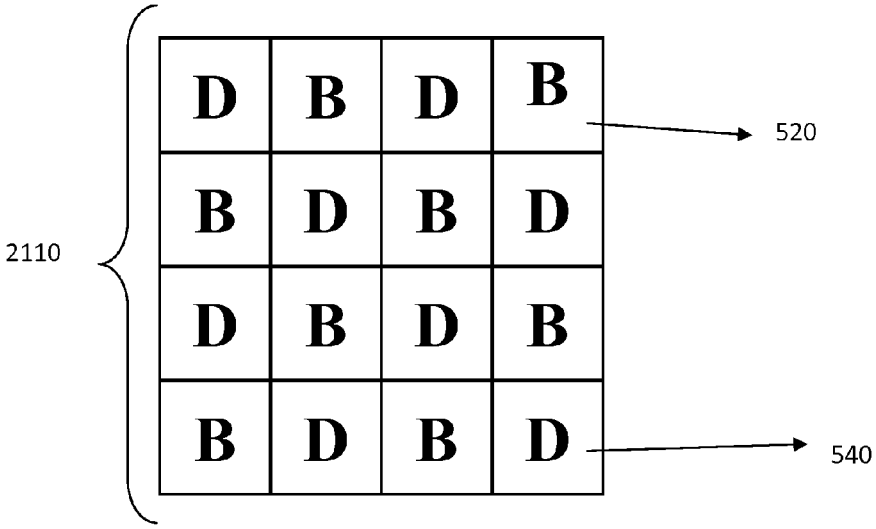
FIG. 21

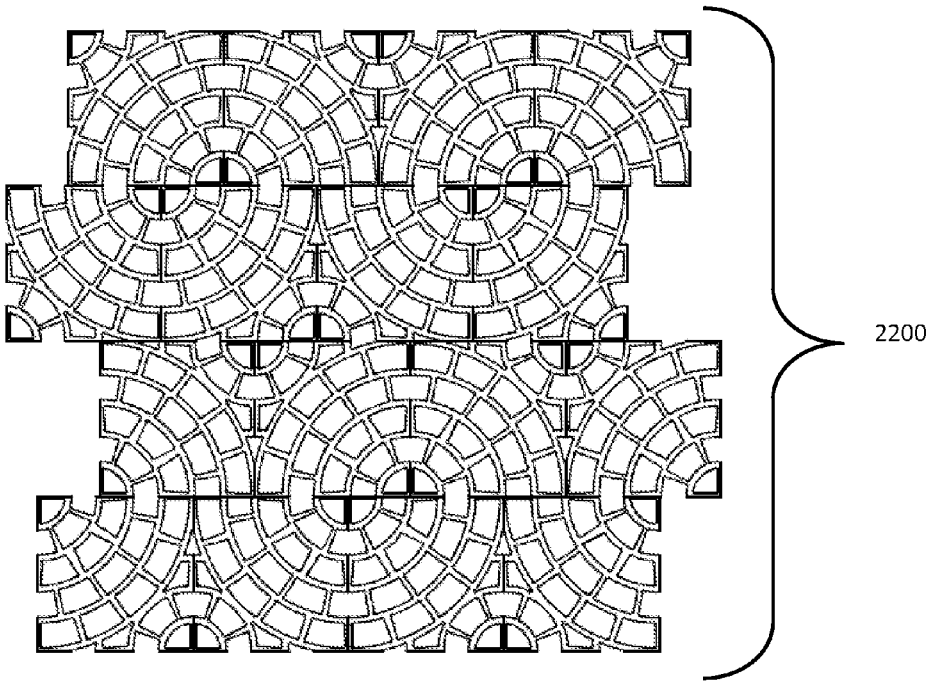
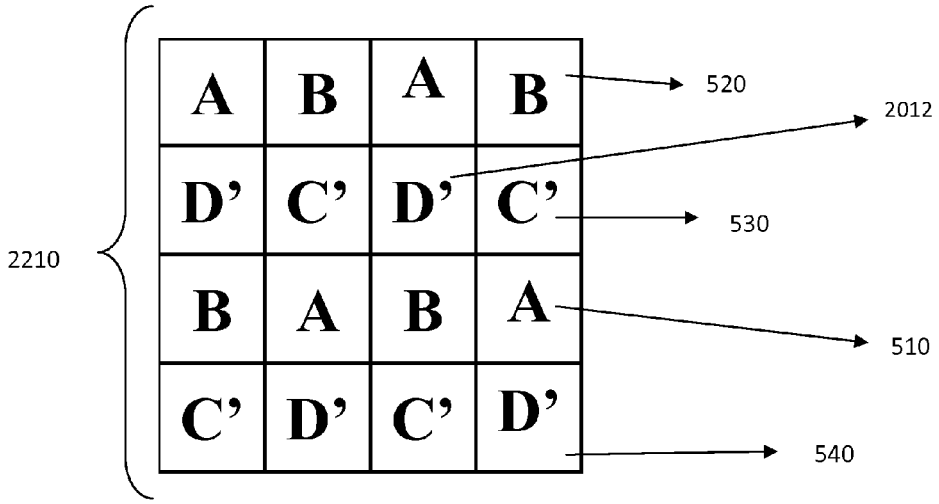
FIG. 22

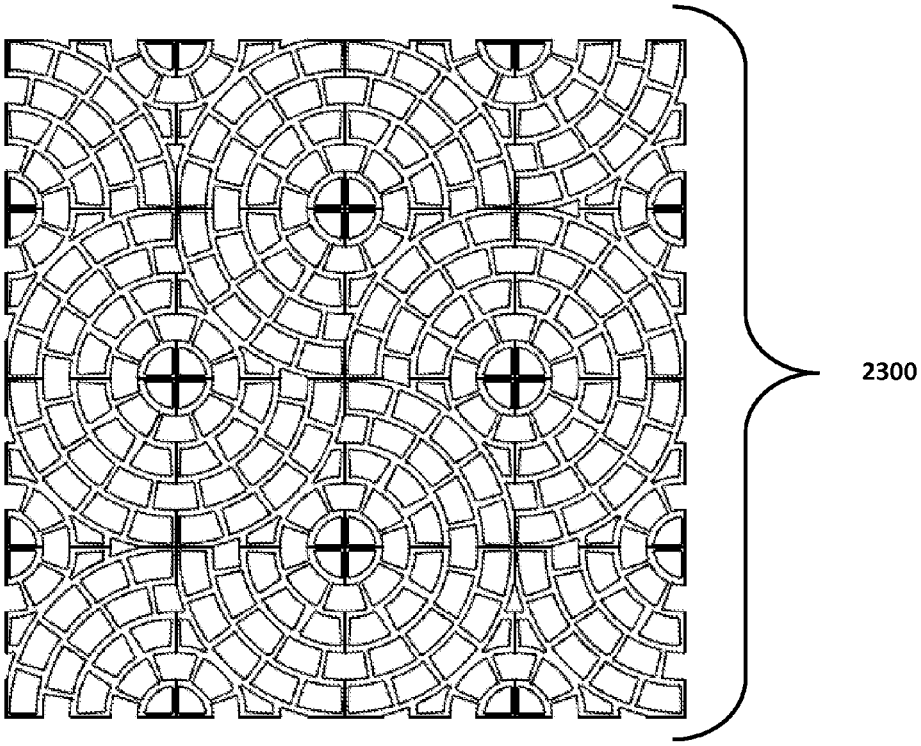
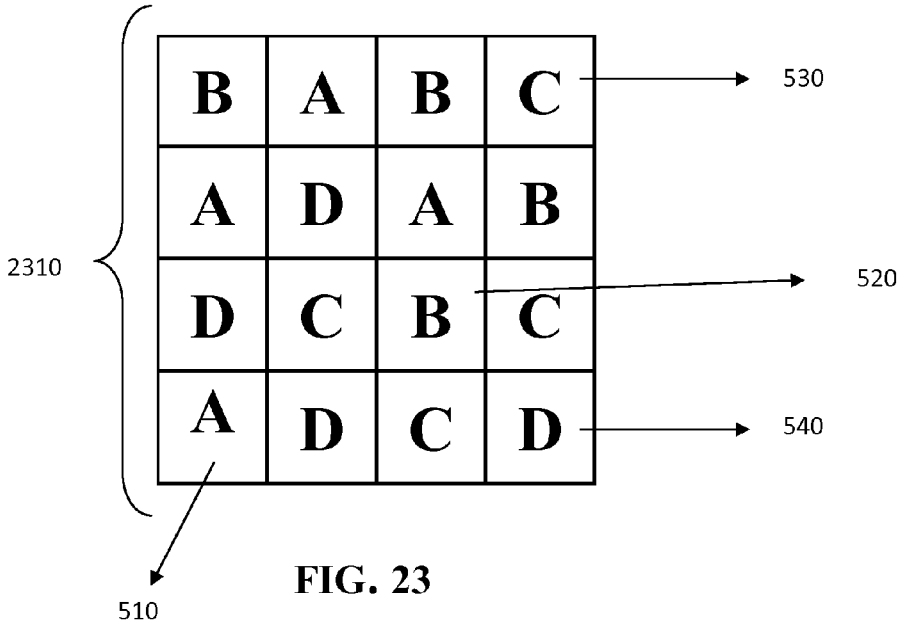
FIG. 23

METHOD OF FORMING AN INLAID PATTERN IN AN ASPHALT SURFACE FROM PREFORMED TEMPLATE ISOMETRIES

PRIORITY STATEMENT(S)

The following application claims benefit of U.S. Design patent application Ser. No. 29/417,030, filed on Mar. 29, 2012 and US Design Applications, filed on Aug. 29, 2012, for the following application Ser. Nos. 29/430,768, 29/430,770, 29/430,774, 29/430,775, 29/430,776, 29/430,777, 29/430,778, 29/430,779, 29/430,780, 29/430,781, 29/430,782, 29/430,783. In addition, the entire contents of U.S. Pat. No. 7,066,680, assigned to Flint Trading, Inc., are hereby incorporated by reference.

TECHNICAL FIELD

The present invention relates to a method of forming multiple inlaid patterns onto or into an asphalt surface from a single thermoplastic rotatable, homogeneous quarter round surface patterned preform. The pattern may be selected for functional or decorative purposes.

BACKGROUND

Various methods for forming patterns in asphalt surfaces are known in the related art. The Applicant is the owner of U.S. Pat. No. 5,215,402, which describes a method of forming a pattern in an asphalt surface using a removable template. The template is compressed into a pliable asphalt surface to imprint a predetermined pattern simulating, for example, the appearance of bricks, cobblestones, interlocking paving stones or the like. The template is then lifted clear of the asphalt surface and the asphalt is allowed to harden. A thin layer of a cementitious coating may be applied to the imprinted asphalt to enhance the brick and mortar or other desired effect.

In the above-described method the template does not remain inlaid within the asphalt surface. The visual effect is created by the combination of the imprinted pattern and the decorative coating. One very important and distinctive drawback to this method is that the decorative coating may wear off over time, particularly in high traffic areas.

It also known that it is possible to install traffic markings on asphalt surfaces. However, such markings typically extend and project above the asphalt surface and are relatively bulky. In regions receiving frequent snowfalls during the winter months, traffic markings may often be removed or damaged during snowplow usage.

Another known method for producing traffic markings involves grinding grooves in asphalt surfaces and then pouring into these grooves a hot molten material which is allowed to set in place. However, this is a very time consuming procedure, and is not well suited for forming complicated patterns, or covering large surface areas. The need therefore exists and remains for improved methods and materials needed to provide inlayed patterns in asphalt surfaces.

SUMMARY OF INVENTION

In accordance with the invention, a method of forming multiple inlaid patterns into or onto an asphalt surface from a single homogeneous, rotatable quarter round surface patterned preform is disclosed. The method of forming multiple inlaid patterns to complete a final predetermined rotational pattern onto or into a pavement surface includes the steps of:

(a) providing a template for creating multiple blocks with portions of rotational isometric patterns;

(b) impressing the template into the pavement surface when the surface is in a pliable state to form an impression therein;

(c) removing the template from the surface to expose the impression;

(d) providing an inlaid rotatable preform grid that at least partially matches the pattern of the template;

(e) inserting the rotatable preform grid into the impression caused by the template;

(f) fixing the rotatable preform grid in position within the impression to form the inlaid pattern;

thereby;

(g) creating multiple blocks of the portions of the patterns such that rotational isometric patterns form a final rotational predetermined isometric patterned preform.

The method may include the step of heating the asphalt surface prior to impressing the template into the asphalt surface.

The method of step (a) includes determining the location of each preform isometry in the predetermined pattern. The decided locality of the thermoplastic, rotatable, homogeneous quarter round surface patterned preform within the predetermined pattern is determined by a combination of quadrant, location and rotation within a coded chart, wherein the final rotational predetermined isometric patterned preform is formed using patterned orthant coding descriptors describing quadrants designated as (Q#), individual patterned square locations designated as (L#), and rotational patterned positions designated as (R*), where # represents the corresponding location or quadrant number and * represents the corresponding letter associated with each angular rotational position expressed in degrees from a vertical y-axis. Multiple patterned templates and/or grids are constructed from a single isometric preform (quarter round portion) that is provided in various combinations. This single isometric preform is repeated using quadrant, location, and rotational positioning. The predetermined pattern may serve a specific function such as a crosswalk marking, or it may be purely decorative.

The impression may consist of a plurality of channels or simulated grout lines. By way of another embodiment, the impression may be the outline of a corporate logo or decorative design. Grids may be manufactured in mats approximately 2' by 2' in size for ease of handling. Multiple grids may be arranged to cover a large surface area. The grids could be arranged so that the frame elements of adjacent grids are partially overlapping at the joinder sites. The gradual heating method described above could be continued until the overlapping frame elements melt together and adhere.

The step of fixing the grid in position within the impression comprises heating the grid to cause the grid to bond to the asphalt surface. For example, the grid may be heated to a temperature within the range of about 100 degrees Fahrenheit to 400 degrees Fahrenheit and more preferably within the range of 150 degrees Fahrenheit to 350 degrees Fahrenheit, depending on the type of asphalt.

The grid may be comprised of a preformed thermoplastic of unitary construction. The color of the grid may be selected to contrast with the color of the asphalt surface. In another embodiment the grid may include retroreflective elements or a mixture of retroreflective elements and other additives. In one embodiment the grid may be constructed from a skid-resistant material and/or contain skid resistant additives.

In a further alternative embodiment the template and grid may include a plurality of frame elements defining open areas therebetween, the open areas comprising approximately 50-90 percent of the total surface area of each template and/or grid.

In one embodiment the grid may comprise an upper surface which is substantially flush with the surface of the asphalt when the grid is fixed in position. Alternatively, a portion of the grid may be raised above the asphalt surface or recessed below the asphalt surface when it is set in place.

The template and grid may be formed from a plurality of frame elements each having a relatively narrow width to facilitate compression of the template and/or grid into the asphalt surface without the need to apply substantial compactive force. For example, the frame elements may normally have a width between ¼ inch and 4 inches. The thickness of the grid is normally between 80 and 100 mil and the thickness of the template is between 125 and 200 mil.

In an alternative embodiment the grid may be compressed into the asphalt surface directly while the asphalt surface is in a pliable state and without deforming the desired predetermined pattern. The grid is then fixed in place as in the embodiment described above.

In another alternative embodiment, the single isometric thermoplastic, rotatable, homogeneous quarter round surface patterned preform is produced as thermoplastic sheeting, as described in commonly owned U.S. Pat. No. 7,645,503, composed of two or more independent sections. The first section is a grid, which in one specific case replicates the appearance of mortar joints as they would form a brick wall. An additional or second section could for example, replicate bricks which are contained within the grid section. The first and second sections possess a hot melt adhesive spray that is utilized on the bottom surface of the marking pattern to bridge the intersections between the first and second sections to maintain the integrity of the marking pattern for convenience during handling and application to a substrate and packaged for shipment. Preferably the hot melt spray adhesive has approximately the same softening point range as the patterned sections, to accommodate heat treatment of the marking pattern during application of the marking pattern to the substrate and eventually to the pavement. In this embodiment, the grid could be replaced by continuous thermoplastic sheets formed in the desired shape and pattern. These thermoplastic sheets may not be inlaid into the pavement but may nevertheless be gently heated as described above to adhere to the underlying asphalt substrate.

In a further embodiment the grid comprises a retroflective element including glass beads and skid resistant element that provides the template with retroflective capabilities after the template is fixed in position within said impression.

Another further embodiment provides the grid as luminescent and/or fluorescent.

In another embodiment the preform can be used for comparatively large thermoplastic surfaces, such as corporate logos, traffic markings, pedestrian walkways, driveways or the like.

BRIEF DESCRIPTION OF THE DRAWINGS

The drawings listed as FIGS. 1-23 below are precise embodiments of the invention, but should not be construed as restricting the spirit or scope of the invention in any way.

FIG. 12 is an aerial perspective of an embodiment of a completed design, displaying a uniform pattern coding of identical rotational patterned positions and the corresponding pattern coding chart.

FIG. 13 is a plan elevational view of an embodiment of a completed design, displaying a scallop pattern coding of rotational patterned positions and the corresponding pattern coding chart.

FIG. 15 is a plan elevational view of an embodiment of a completed design, displaying a stacked arch pattern coding of rotational patterned positions and the corresponding pattern coding chart.

FIG. 16 is a plan elevational view of an embodiment of a completed design, displaying a star pattern coding of rotational patterned positions and the corresponding pattern coding chart.

FIG. 18 is a plan elevational view of an embodiment of a completed design, displaying an inverted wave pattern coding of rotational patterned positions and the corresponding pattern coding chart.

FIG. 19 is a plan elevational view of an embodiment of a completed design, displaying a translated wavy pattern coding of rotational patterned positions and the corresponding pattern coding chart.

FIG. 20 is a plan elevational view of an embodiment of a completed design, displaying a reflected wavy pattern coding of rotational patterned positions and the corresponding pattern coding chart.

FIG. 21 is a plan elevational view of an embodiment of a completed design, displaying an alternating inverted wavy pattern coding of rotational patterned positions and the corresponding pattern coding chart.

FIG. 22 is a plan elevational view of an embodiment of a completed design, displaying a swirled wave pattern coding of rotational patterned positions and the corresponding pattern coding chart.

FIG. 23 is a plan elevational view of an embodiment of a completed design, displaying a stacked wheel pattern coding of rotational patterned positions and the corresponding pattern coding chart.

DETAILED DESCRIPTION OF THE DRAWINGS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
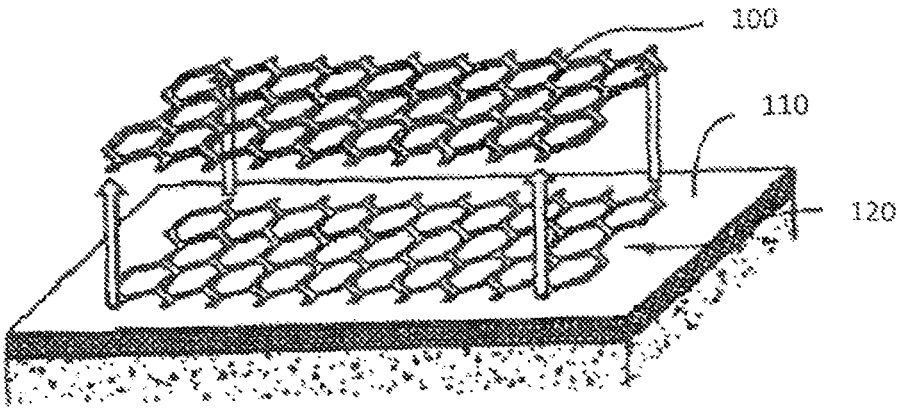
FIG. 1 is a perspective view of a removable rigid template used to impress a pavement surface.

FIG. 1 is a perspective view of a removable rigid template [100] used to leave an impression [110] in a pavement surface [120].

Figure 2:
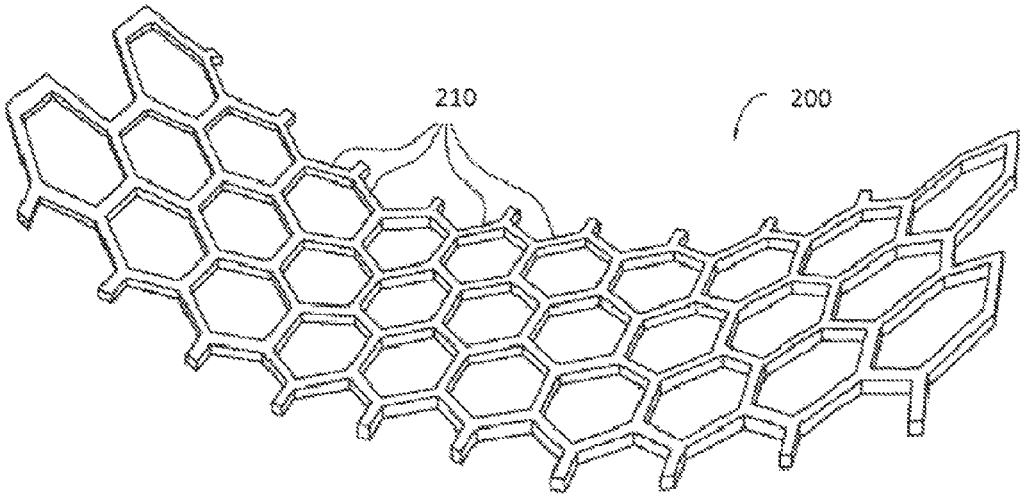
FIG. 2 is a perspective view of an example of a flexible grid used to fill an impressed pavement surface.

FIG. 2 is a perspective view of a flexible grid [200] defined by frame elements [210] of corresponding shape to the impression [110] provided by the template [100], as shown in FIG. 1.

Figure 3:
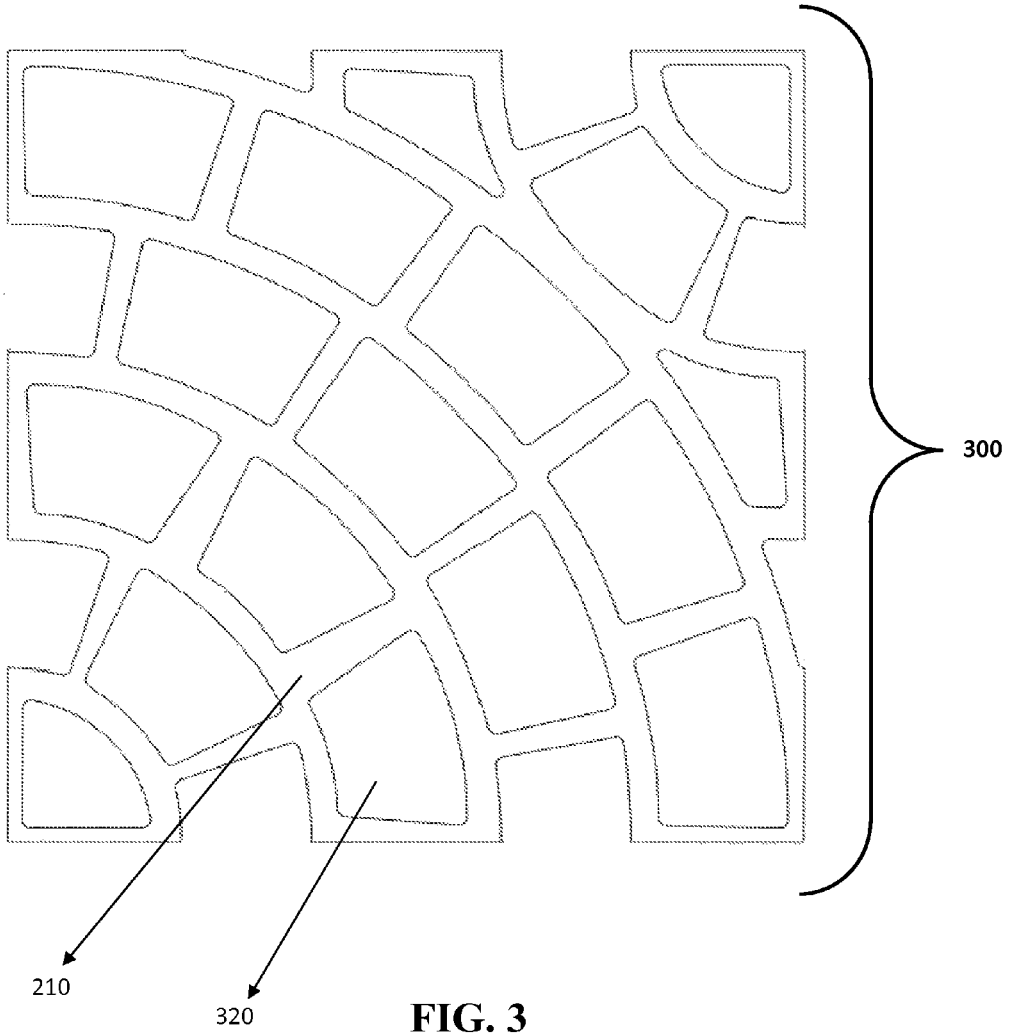
FIG. 3 is a top plan view of a thermoplastic rotatable, homogeneous quarter round surface patterned preform for traffic patterns.

FIG. 3 is a top plan view of a thermoplastic, rotatable, homogeneous quarter round surface patterned preform [300] for traffic patterns. As shown in FIG. 2, frame elements [210] of the thermoplastic, rotatable, homogeneous quarter round surface patterned preform [300] may define a plurality of open areas [320]. In one embodiment of the invention, open areas [320] comprise approximately 50-90% of the total surface area of the thermoplastic, rotatable, homogeneous quarter round surface patterned preform [300]. Conversely closed areas defined by frame elements [210] comprise approximately 10-50% of the total surface area of the thermoplastic, rotatable, homogeneous quarter round surface patterned preform [300].

Figure 4:
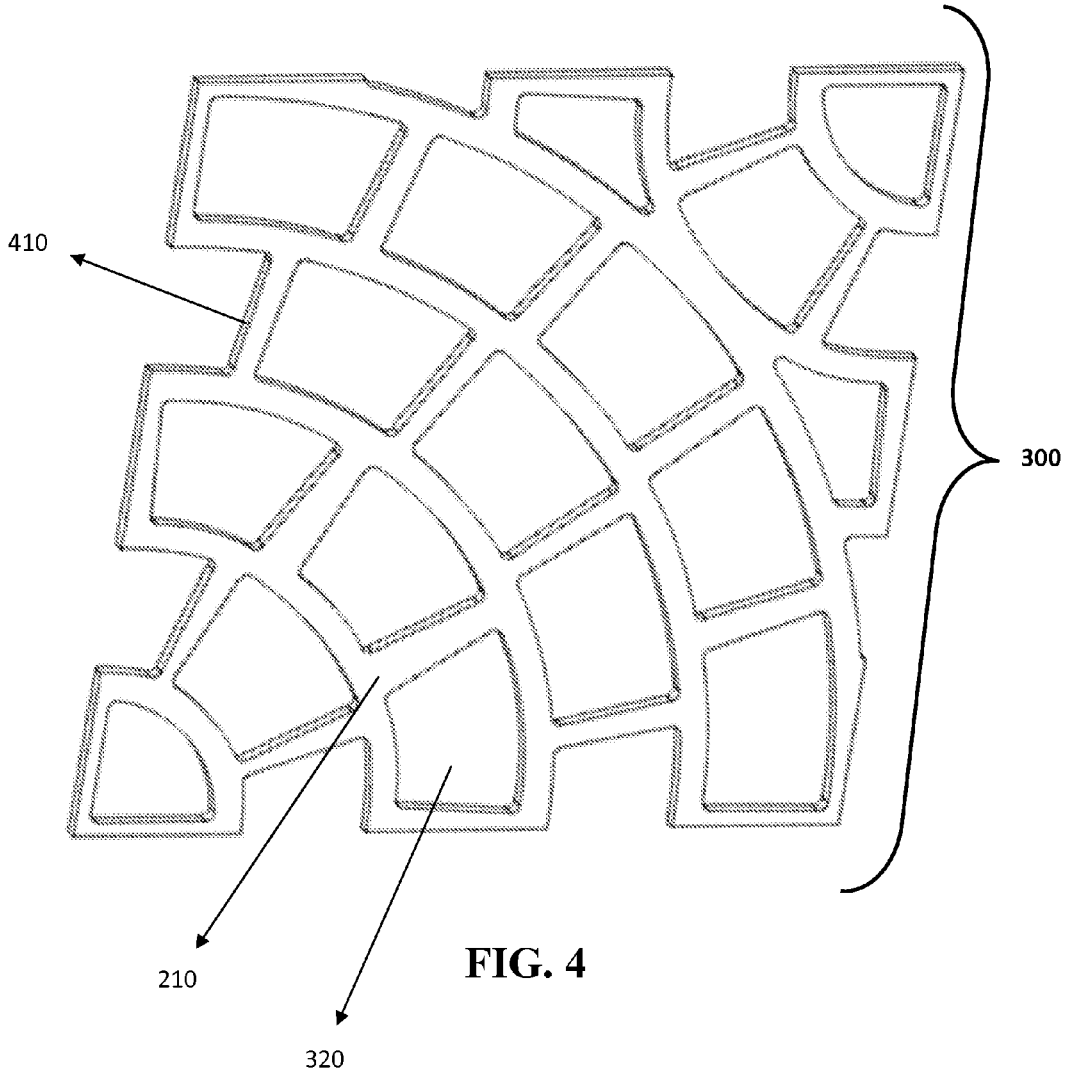
FIG. 4 is a perspective view of FIG. 3.
Figure 5A:
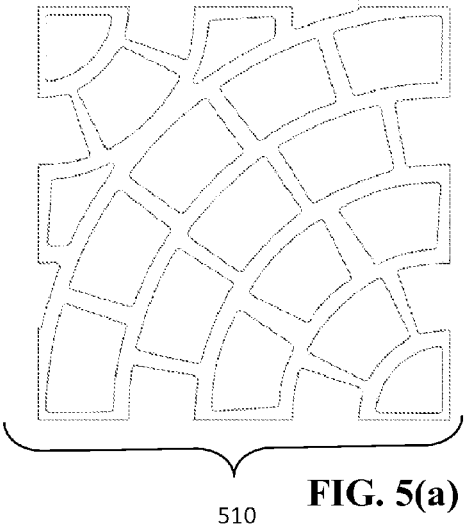
FIGS. 5 (*a-d*) are top plan views of surface patterned preforms in rotational patterned positions.
Figure 5B:
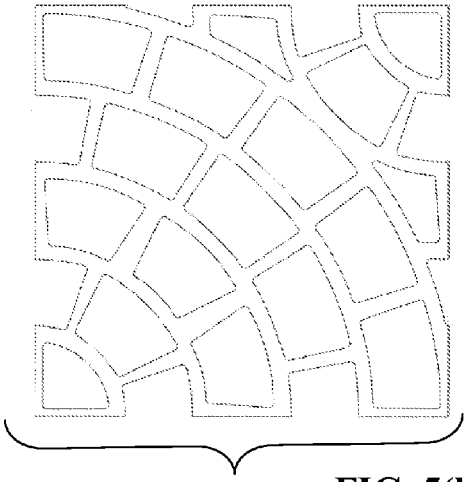
Figure 5D:
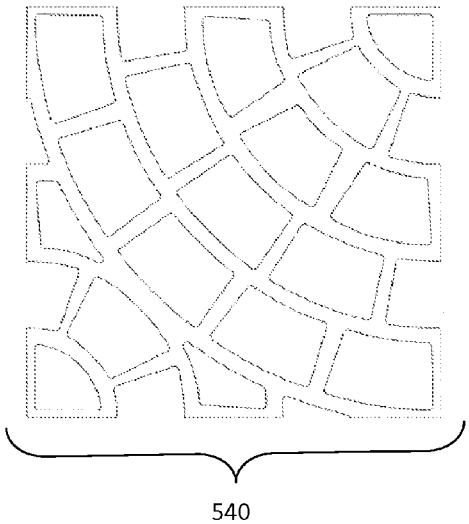
Figure 5C:
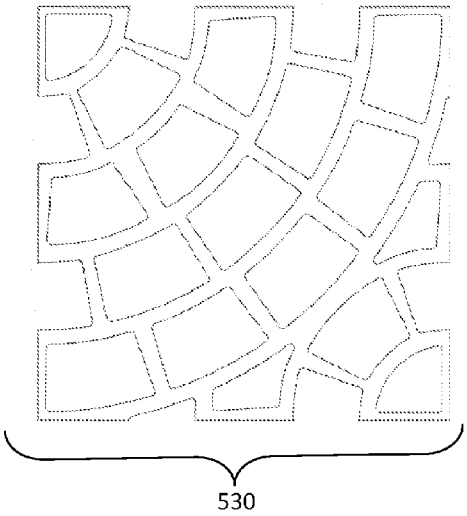
Figure 6A:
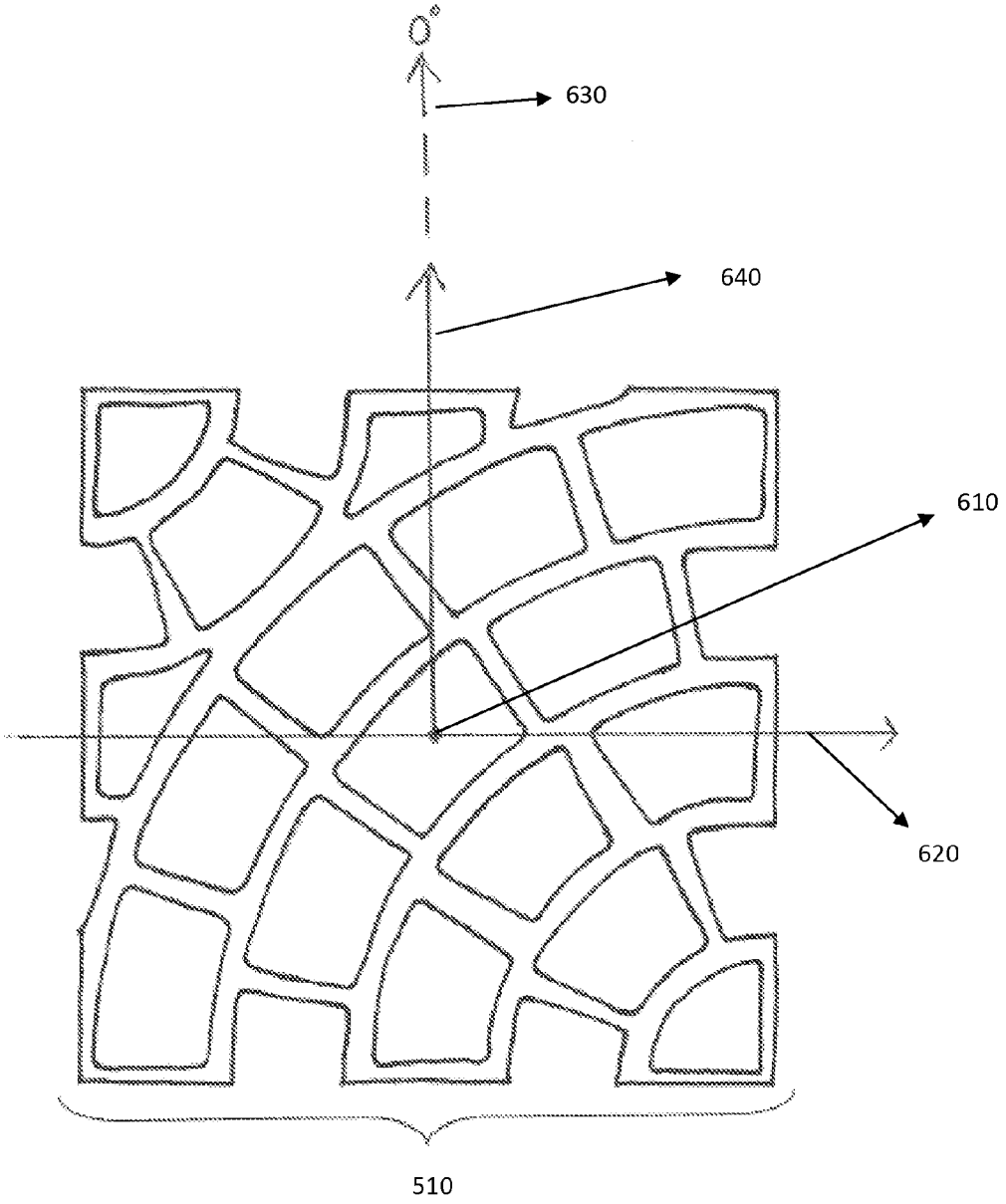
FIGS. 6(*a-d*) display the rotational patterned positions as they are revolved about a central axis.
Figure 6B:
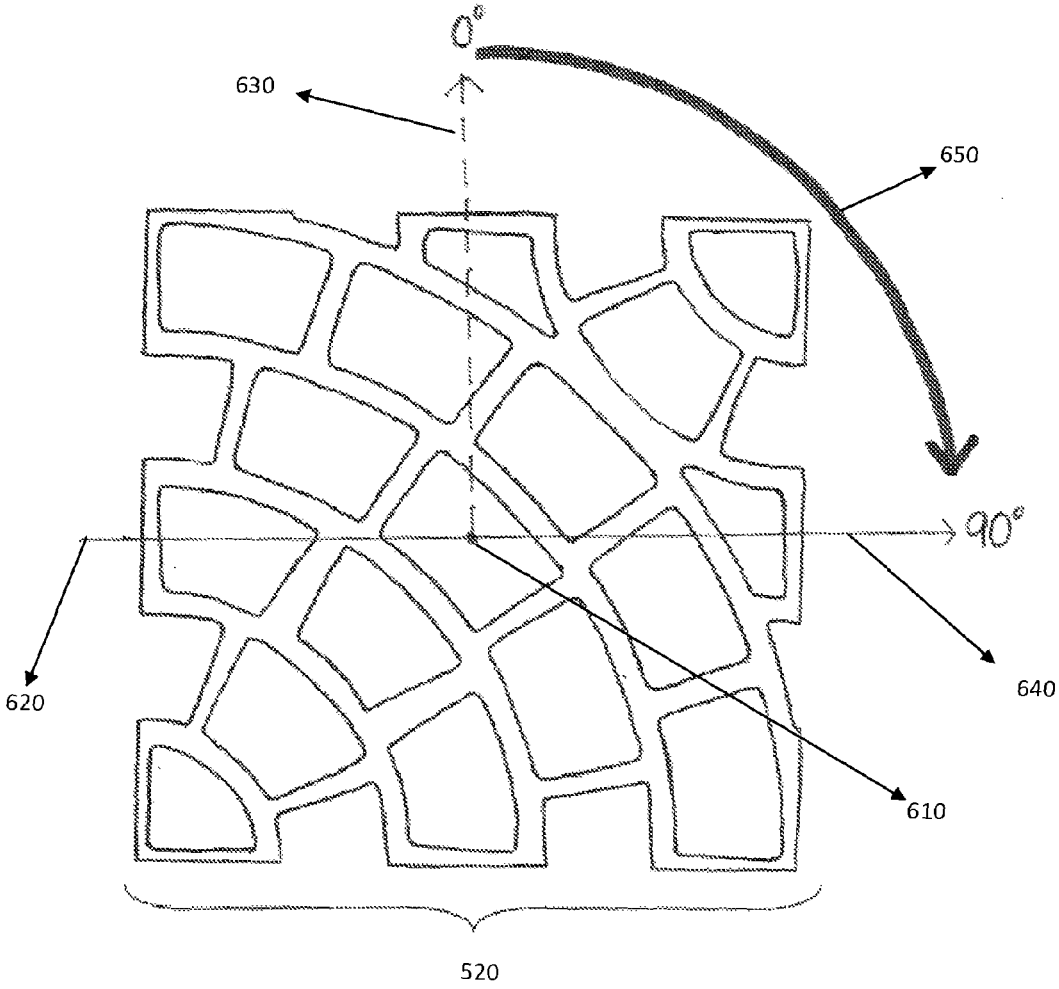
Figure 6C:
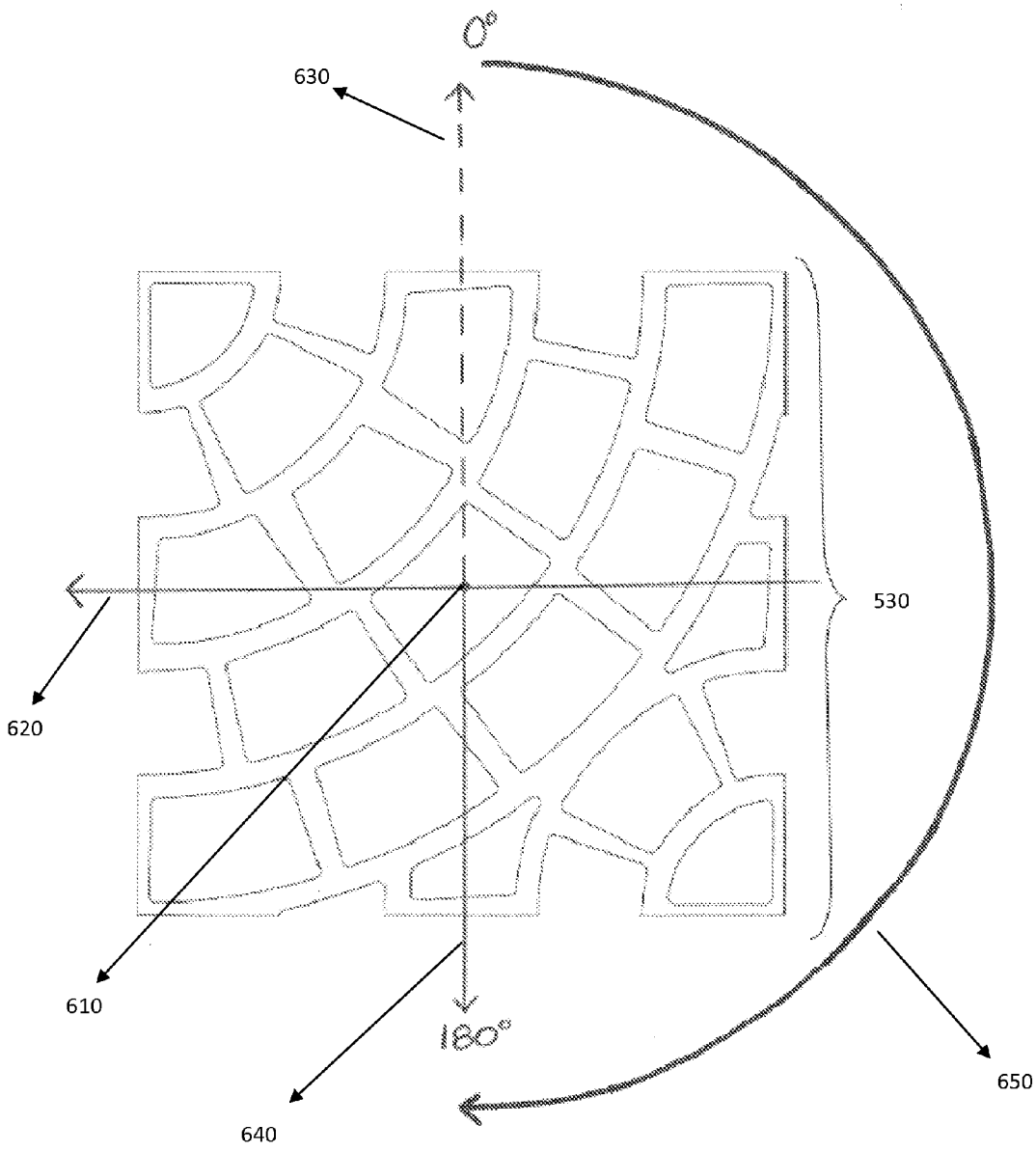
Figure 6D:
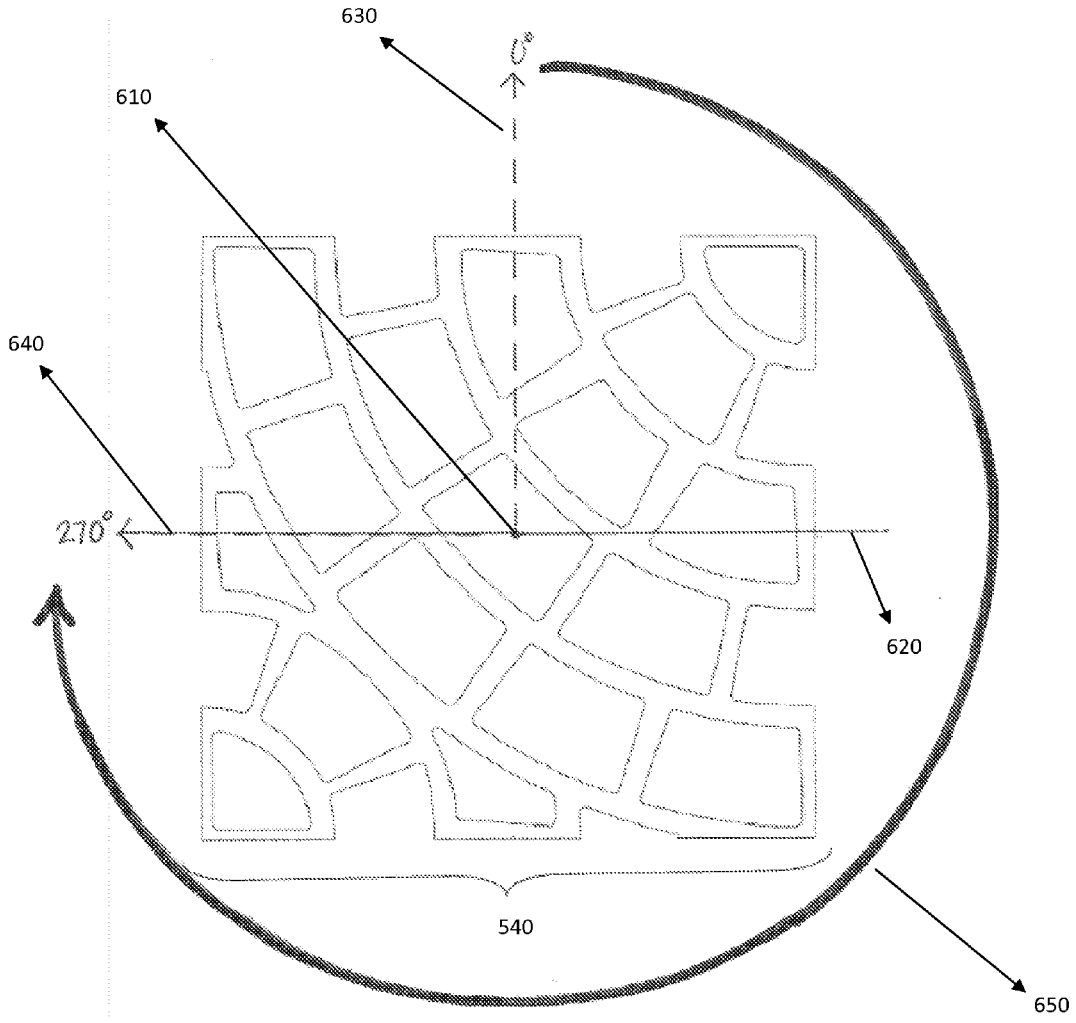

FIG. 4 is a perspective view of FIG. 3 illustrating the three-dimensional side wall aspect [410] of the thermoplastic, rotatable, homogeneous quarter round surface patterned preform [300].

FIGS. 5 (*a-d*) are top view depictions of the various isometries available about a central axis of rotation for the thermoplastic, rotatable, homogeneous quarter round surface patterned preform [300] with surface patterned preform rotation intervals at 0°, 90°, 180°, and 270° respectfully. FIG. 5 (*a*) shows rotational patterned position A [510] which corresponds to a 0° rotation. Rotational patterned position B [520] corresponds to a 90° rotation as shown in FIG. 5 (*b*). Rotational patterned position C [530] corresponds to a 180° rotation as shown in FIG. 5 (*c*). Rotational patterned position D [540] corresponds to a 2700 rotation as shown in FIG. 5 (*d*).

FIGS. 6(*a-d*) are top view illustrations of isometric thermoplastic, rotatable, homogeneous quarter round surface patterned perform(s) [300]. FIG. 6(*a*) shows rotational patterned position A [510] with a marked fixed point [610], corresponding to an origin point, through which the x-axis [620] and the y-axis [630] intersect. Rotational patterned position A [510] corresponds to a 0° rotation from the y-axis [630]. FIG. 6(*b*) shows rotational patterned position B [520] with a marked fixed point [610], corresponding to the origin, through which the x-axis [620] and the y-axis [430] intersect. Rotational patterned position B [520] corresponds to a 90° rotational position [650] from the y-axis [630]. FIG. 6(*c*) shows rotational patterned position C [530] with a marked fixed point [610], corresponding to the origin, through which the x-axis [620] and the y-axis [630] intersect. Rotational patterned position C [530] corresponds to a 180° rotational position [650] from the y-axis [630]. FIG. 6(*d*) shows rotational patterned position D [540] with a marked fixed point [610], corresponding to the origin, through which the x-axis [620] and the y-axis [630] intersect. Rotational patterned position D [540] corresponds to a 2700 rotational position [650] from the y-axis [630].

Figure 7:
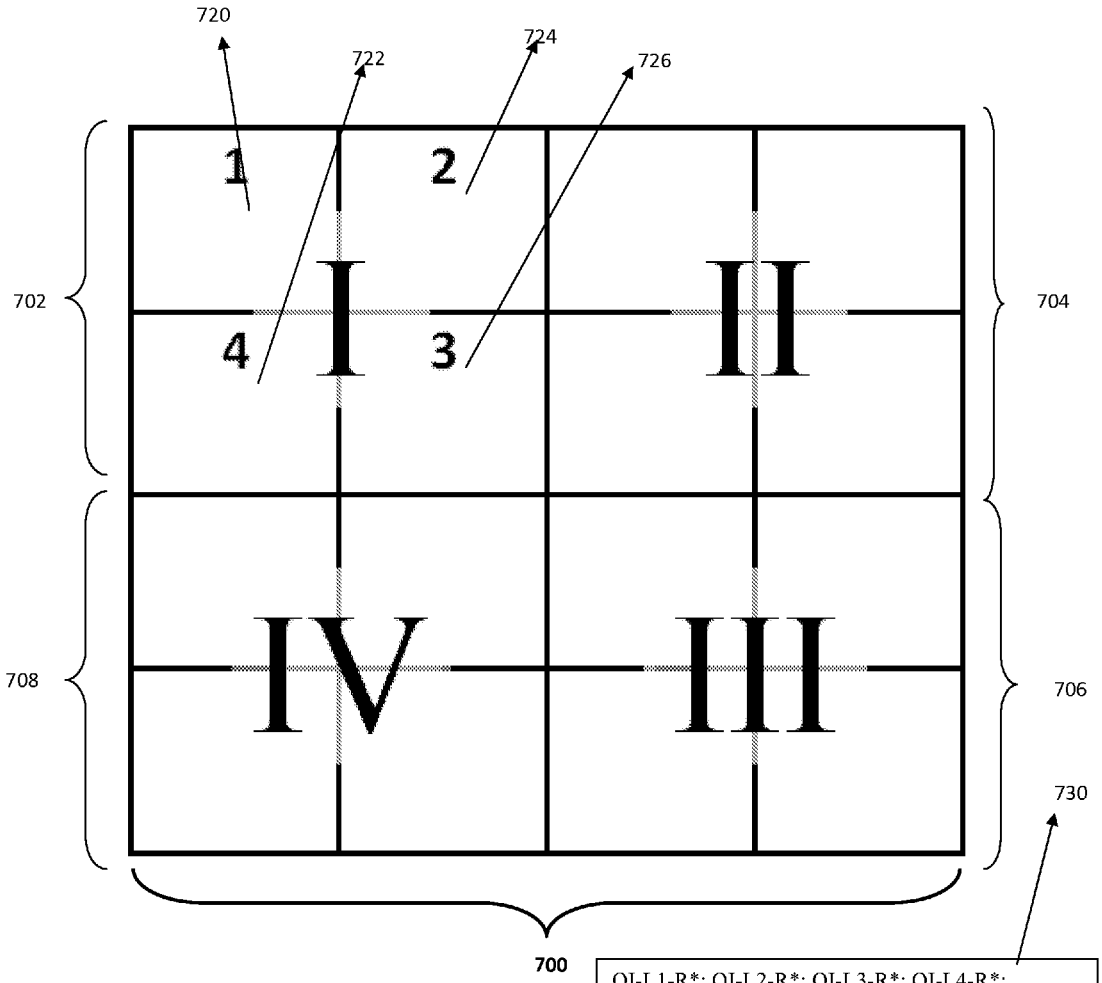
FIG. 7 is a graphical representation of a coordinate coding chart for the reproducible assembly of a combination of several thermoplastic, rotatable surface patterned preforms.

FIG. 7 is a 4×4 graphical representation of a patterned orthant coding chart [700] for the creation of multiple block pattern portions. Quadrant I [702] is located in the top left portion of the patterned orthant coding chart [700] and consists of four (4) individual patterned square locations [720-726] in a 2×2 configuration, with individual patterned square location 1 [720] located in the top left quarter of Quadrant I [702], individual patterned square location 2[722] located in the top right quarter of Quadrant I [702], individual patterned square location 3 [724] located in the bottom right quarter of Quadrant I [702] and individual patterned square location 4[726] located in the bottom left quarter of Quadrant I [702]. The position of each individual patterned square location [720, 722, 724, 726] is unchanged in each of the subsequent quadrants II [704], III [706] and IV [708].

The quadrants [702, 704, 706, 708] are numbered in a clockwise manner, opposite to the otherwise conventional counter-clockwise mathematical custom and individual patterned square location 1 [720] in each quadrant. The coding pattern of rotational patterned positions for Quadrant I [702] can be repeated, or varied, in Quadrants II [704], III [706] and IV [708].

A written description of the contents of the patterned orthant coding chart [700] can be provided as a patterned orthant coding descriptor [730]. The patterned orthant coding descriptor [730] describes the quadrant [702-708](Q#), individual patterned square location [720-726](L#), and rotational patterned position [710-740](R*), where # represents the corresponding number and * represents the corresponding letter associated with each position. The completed patterned orthant coding descriptor [730] is provided as QI-L1-R*: QI-L2-R*: QI-L3-R*: QI-L4-R*; QII-L1-R*: QII-L2-R*: QII-L3-R*: QII-L4-R*; QIII-L1-R*: QIII-L2-R*: QIII-L3-R*: QIII-L4-R*; QIV-L1-R*: QIV-L2-R*: QIV-L3-R*: QIV-L4-R*.

Figure 8:
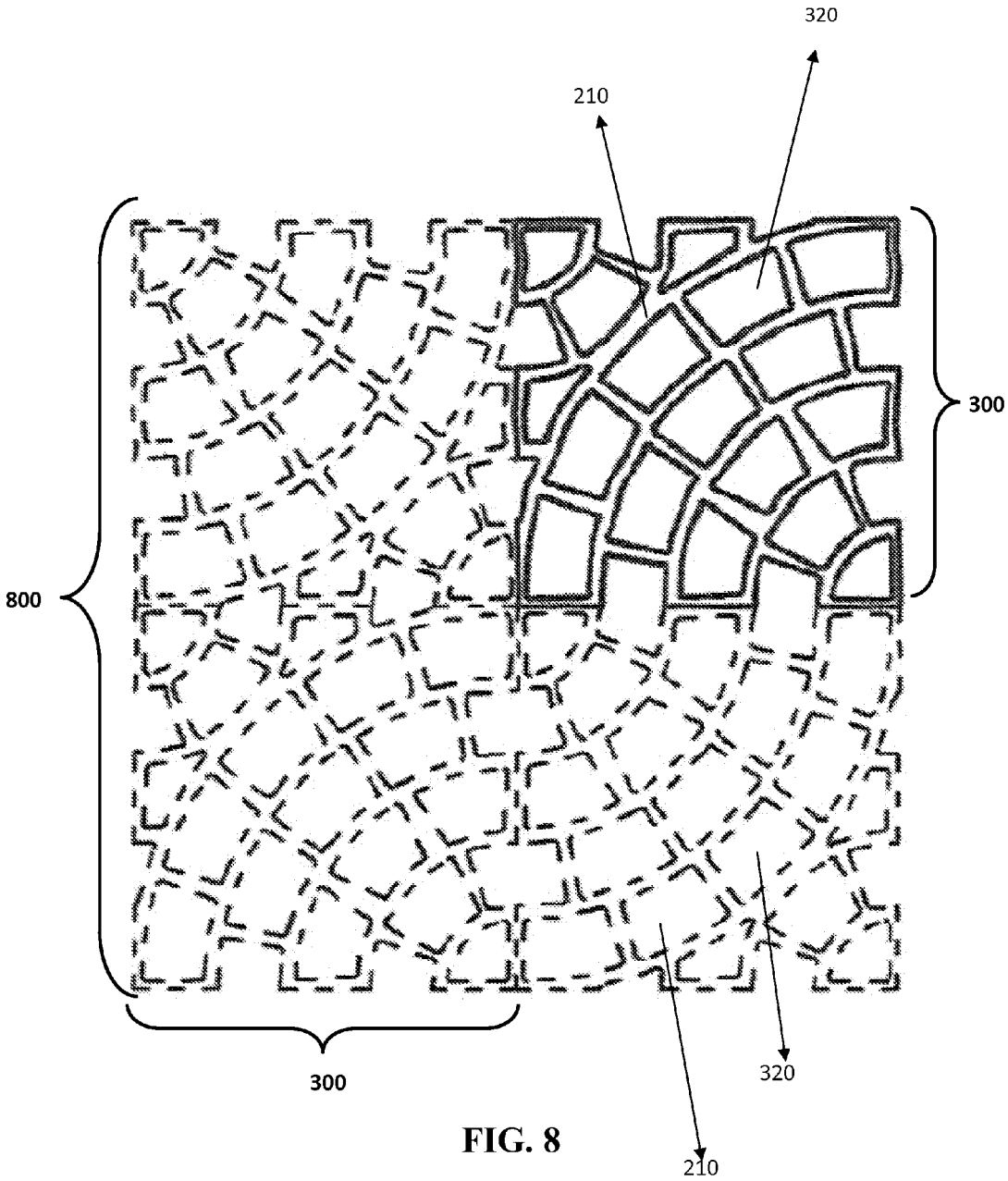
FIG. 8 is a top plan view of the assembly of a combination of several thermoplastic, rotatable surface patterned preforms creating a specially designated design portion of the desired pattern.

FIG. 8 is a top plan view of the assembly of a combination of several thermoplastic, rotatable, homogeneous quarter round surface patterned preforms [300] creating a 2×2 patterned preform [800]. A 2×2 patterned preform [800] contains a single quadrant, Quadrant I [702], and the individual patterned square locations 1-4 [720-726] are included within the quadrant. Rotational patterned positions A [510], B [520], C [530] and D [540] occupy the individual patterned square locations 1-4 [720-726] in placements congruent to the desired 2×2 patterned preform [800].

Figure 9:
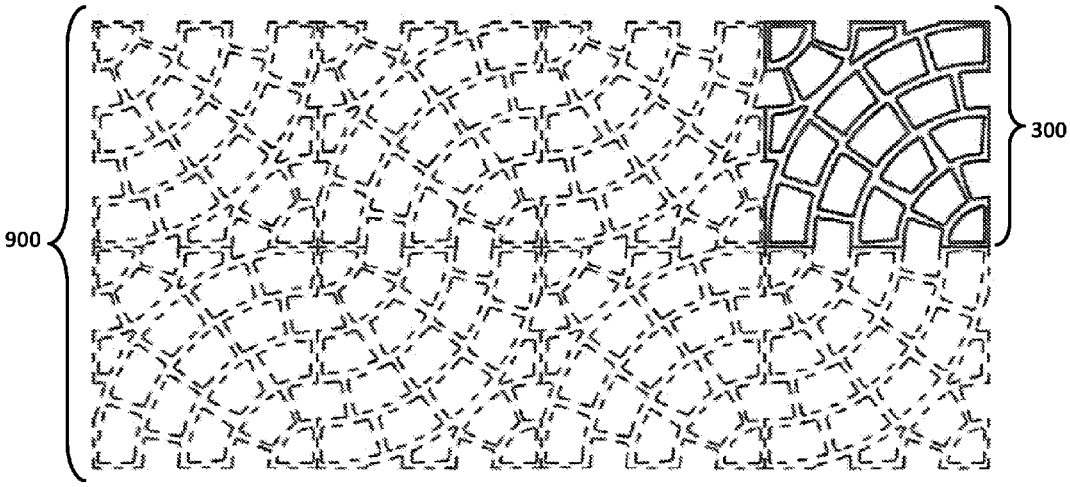
FIG. 9 is a top plan view of an extended assembly of a plurality of pattern preforms assembled in such a manner as to complete the robust design with the associated desired pattern.

FIG. 9 is another top plan view of the extended assembly of a plurality of thermoplastic, rotatable, homogeneous quarter round surface patterned preforms [300] assembled in such a manner as to form a robust 2×4 patterned preform [900]. A 2×4 patterned preform [900] contains two (2) quadrants, Quadrants I [702] and II [704], and the individual patterned square locations 1-4 [720-726] included within each quadrant. Rotational patterned positions A [510], B [520], C [530] and D [540] occupy the individual patterned square locations 1-4 [720-726] in placements congruent to the desired 2×4 patterned preform [900].

Figure 10:
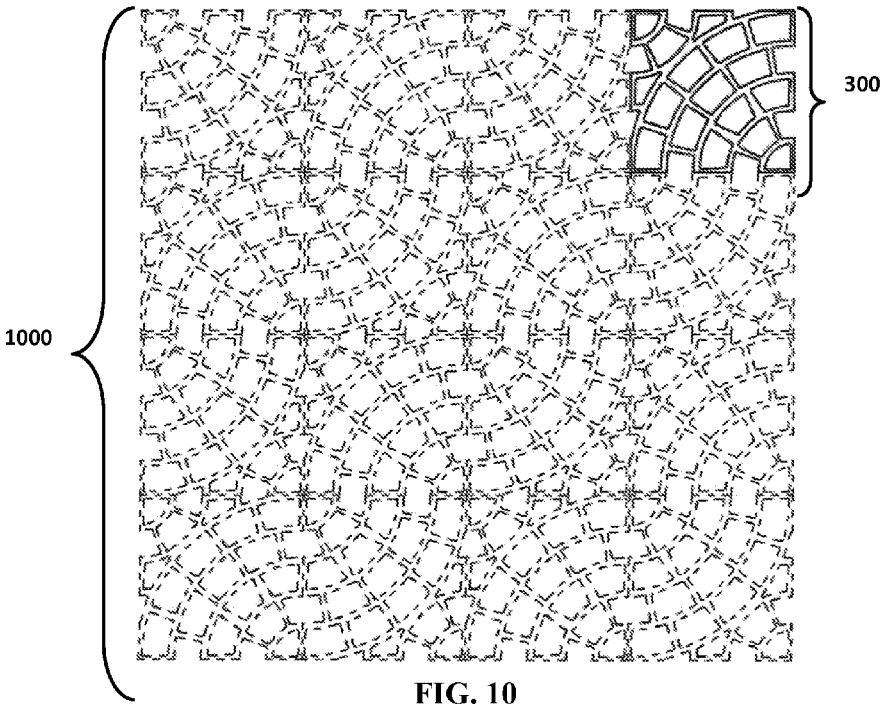
FIG. 10 is another top plan view of an additional extended assembly with multiple block portions providing the robust pattern design with the associated desired pattern.

FIG. 10 is an additional top plan view of a further extended assembly of multiple block portions of thermoplastic, rotatable, homogeneous quarter round surface patterned preforms [300] forming a robust 4×4 patterned preform [1000]. A 4×4 patterned preform [1000] contains Quadrants I [702], II [704], III [706] and IV [708], along with individual patterned square locations 1-4 [720-726] included within each quadrant. Rotational patterned positions A [510], B [520], C [530] and D [540] occupy the individual patterned square locations 1-4 [720-726] in placements congruent to the desired 4×4 patterned preform [1000].

Figure 11A:
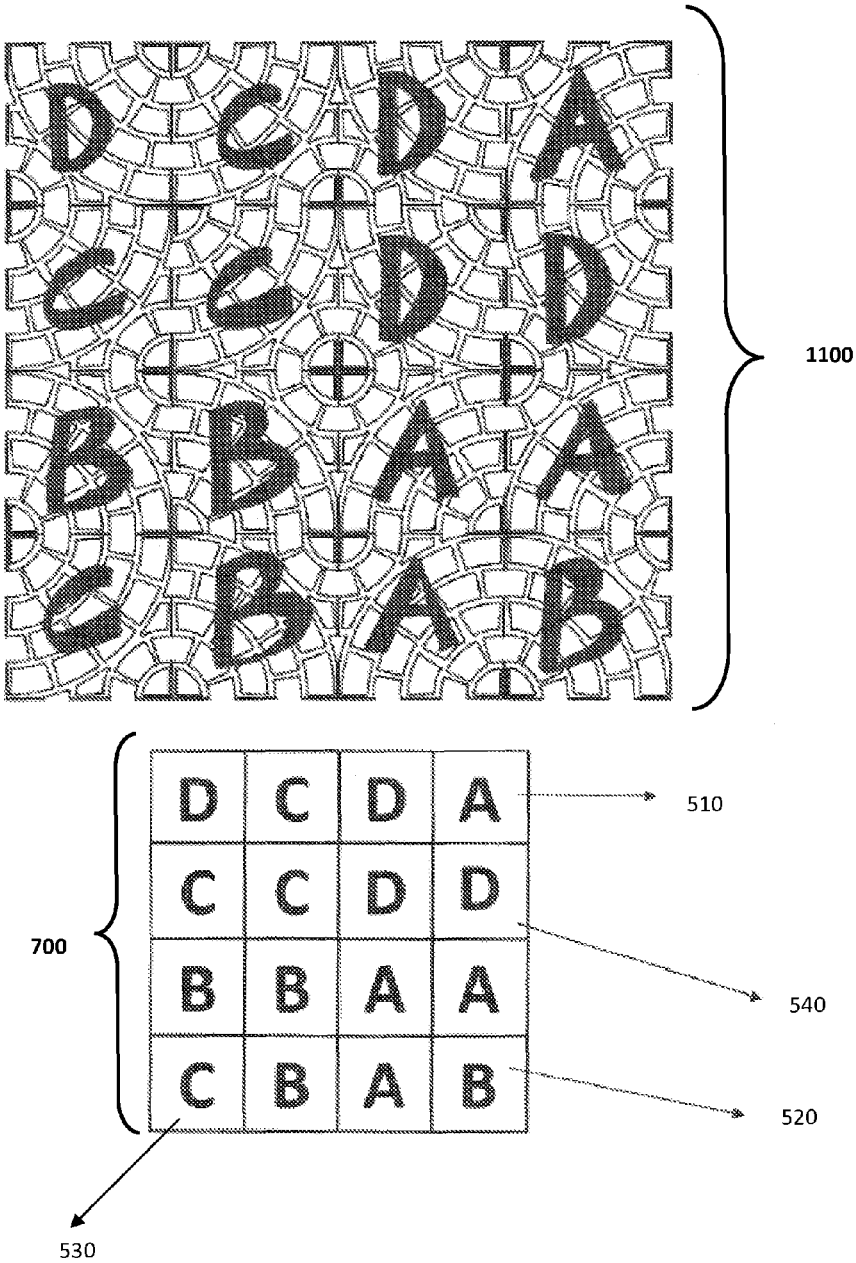
FIGS. 11(*a-b*) depict visual correlations of a completed pattern with the corresponding coordinate coding chart.
Figure 11B:
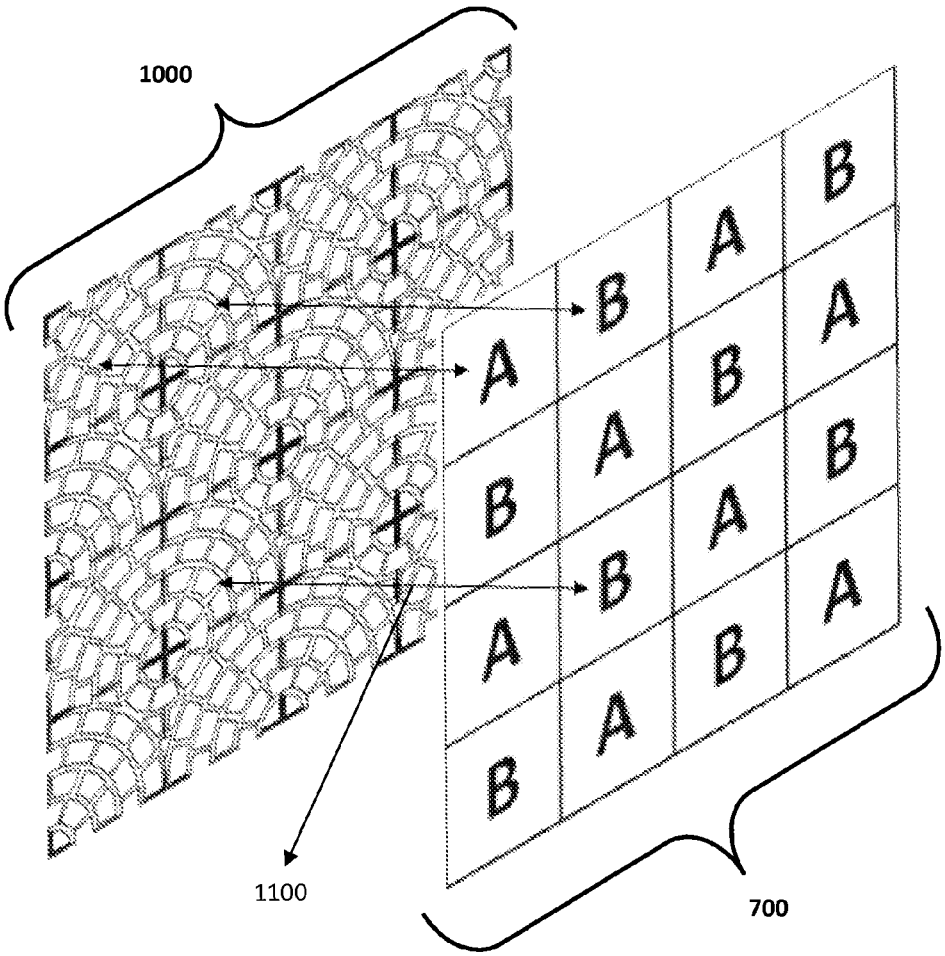

FIG. 11(*a*) provides a superimposition [1100] of a patterned orthant coding chart [700], labeled with the desired rotational patterned positions A-D [510-540] onto the desired 4×4 patterned preform [1000]. FIG. 11(*b*) visually correlates the superimposition [1100] of a patterned orthant coding chart [700] onto the desired 4×4 patterned preform [1000].

FIG. 12 is a plan elevational view of the completed Uniform pattern [1200] and the uniform coding chart [1210]. Rotational patterned position A [510] completes the entirety of the uniform coding chart [1210]. The patterned orthant coding descriptor [730], similar to that shown in FIG. 7, for the uniform coding chart [1210] reads as follows; QI-L1-PA: QI-L2-PA: QI-L3-PA: QI-L4-PA with the coding repeated in all subsequent quadrants.

FIG. 13 is a plan elevational view of a completed Scallop pattern [1300] and the scallop coding chart [1310]. Alternating rotational patterned position A [510] and rotational patterned position B [520] complete the entirety of the scallop coding chart [1310]. The patterned orthant coding descriptor [730], similar to that shown in FIG. 7, for the scallop coding chart [1310] reads as follows: QI-L1-PA: QI-L2-PB: QI-L3-PA: QI-L4-PB with the coding repeated in all subsequent quadrants.

Figure 14:
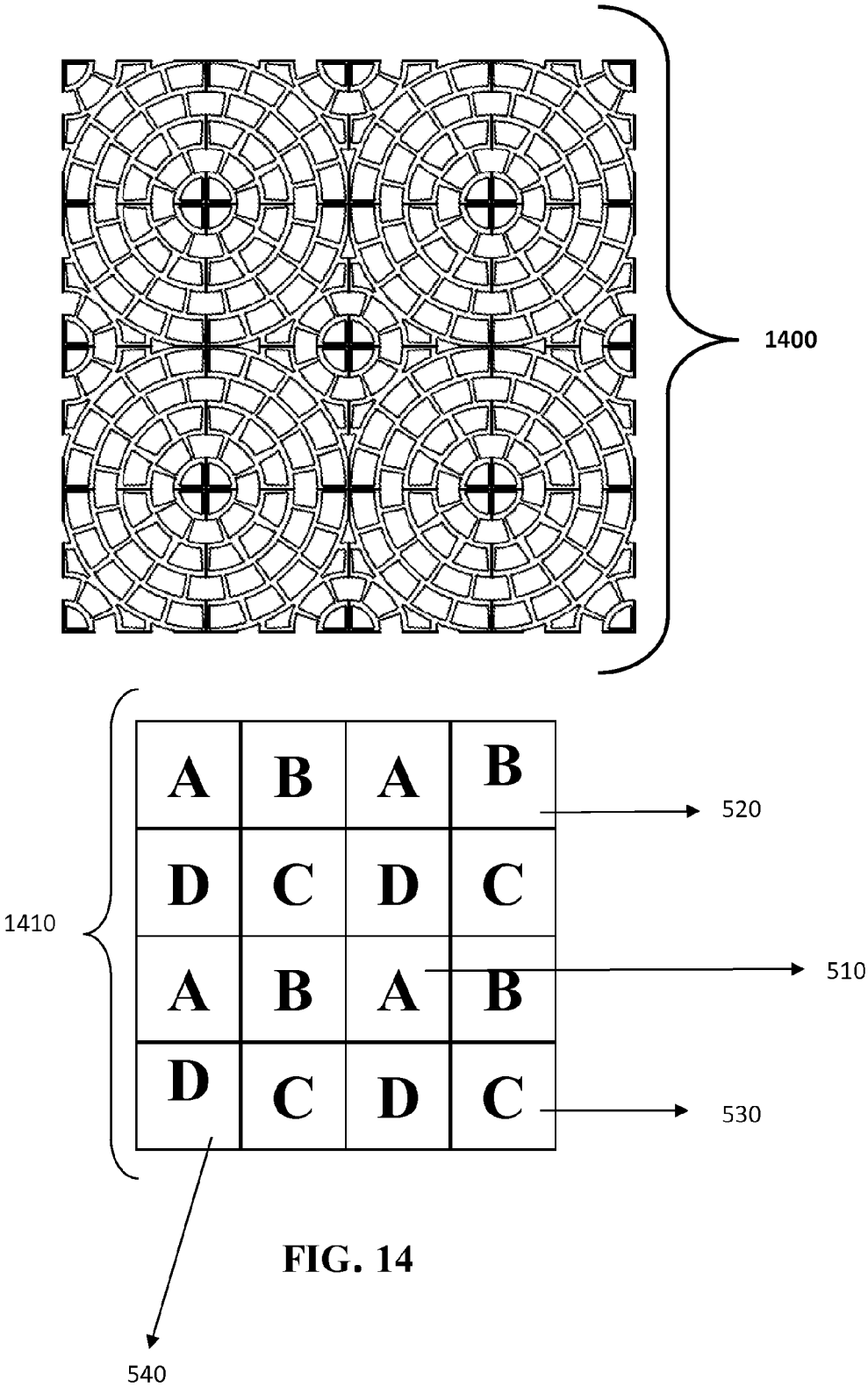
FIG. 14 is a plan elevational view of an embodiment of a completed design, displaying a wheel pattern coding of rotational patterned positions and the corresponding pattern coding chart.

FIG. 14 is a plan elevational view of a completed Wheel pattern [1400] and the wheel coding chart [1410]. Clockwise rotation of the rotational patterned positions A [510], B [520], C [530] and D [540] complete the entirety of the wheel coding chart [1410]. The patterned orthant coding descriptor [730], similar to that shown in FIG. 7, for the wheel coding chart [1410] reads as follows; QI-L1-PA: QI-L2-PB: QI-L3-PC: QI-L4-PD with the coding repeated in all subsequent quadrants.

FIG. 15 is a plan elevational view of a completed Stacked Wheel pattern [1500] and the stacked wheel coding chart [1510]. Alternating rotational patterned position A [510] and rotational patterned position B [520] complete the entirety of the stacked wheel coding chart [1510]. The patterned orthant coding descriptor [730], similar to that shown in FIG. 7, for the scallop coding chart [1510] reads as follows; QI-L1-PA: QI-L2-PB: QI-L3-PB: QI-L4-PA with the coding repeated in all subsequent quadrants.

FIG. 16 is a plan elevational view of a completed Star pattern [1600] and the star coding chart [1610]. Rotational patterned positions A [510], B [520], C [530] and D [540] complete the entirety of the star coding chart [1610]. The patterned orthant coding descriptor [730], similar to that shown in FIG. 7, for the star coding chart [1610] reads as follows; QI-L1-RD: QI-L2-RC: QI-L3-RC: QI-L4-RC; QII-L1-RD: QII-L2-RA: QII-L3-RD: QII-L4-RD; QIII-L1-RA: QIII-L2-RA: QIII-L3-RB: QIII-L4-RA; QIV-L1-RB: QIV-L2-RB: QIV-L3-RB: QIV-L4-RC.

Figure 17:
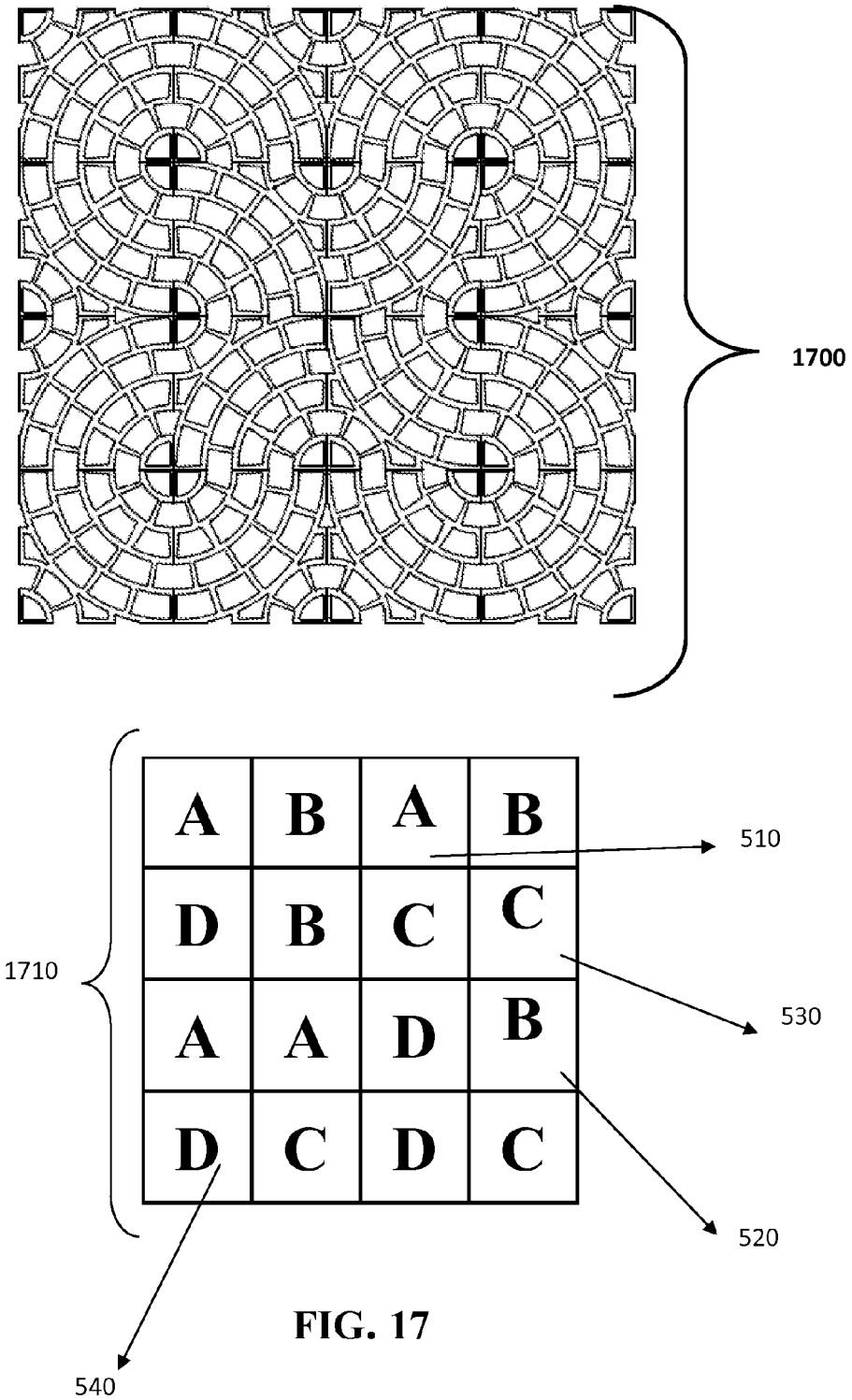
FIG. 17 is a plan elevational view of an embodiment of a completed design, displaying a clover pattern coding of rotational patterned positions and the corresponding pattern coding chart.

FIG. 17 is a plan elevational view of a completed Clover pattern [1700] and the clover coding chart [1710]. Rotational patterned positions A [510], B [520], C [530] and D [540] complete the entirety of the star coding chart [1710]. The patterned orthant coding descriptor [730], similar to that shown in FIG. 7, for the clover coding chart [1710] reads as follows; QI-L1-RA: QI-L2-RB: QI-L3-RB: QI-L4-RD; QII-L1-RA: QII-L2-RB: QII-L3-RC: QII-L4-RC; QIII-L1-RD: QIII-L2-RB: QIII-L3-RC: QIII-L4-RD; QIV-L1-RA: QIV-L2-RA: QIV-L3-RC: QIV-L4-RD.

FIG. 18 is a plan elevational view of a completed Inverted Wave pattern [1800] and the inverted wave coding chart [1810]. Rotational patterned positions A [510], B [520], C [530] and D [540] complete the entirety of the inverted coding chart [1810]. The patterned orthant coding descriptor [730], similar to that shown in FIG. 7, for the inverted wave coding chart [1810] reads as follows; QI-L1-RB: QI-L2-RB: QI-L3-RD: QI-L4-RD; QIII-L1-RA: QIII-L2-RA: QIII-L3-RC: QIII-L4-RC. Coding for Quadrants II [704] and IV [708] correspond to the coding for Quadrants I [702] and III [706], respectively.

FIG. 19 is a plan elevational view of a completed Translated Wavy pattern [1900] and the translated wavy coding chart [1910]. Rotational patterned positions A [510], B [520], C [530] and D [540] complete the entirety of the translated wavy coding chart [1910]. The patterned orthant coding descriptor [730], similar to that shown in FIG. 7, for the translated wavy coding chart [1910] reads as follows; QI-L1-RA: QI-L2-RB: QI-L3-RD: QI-L4-RC with the coding repeated in all subsequent quadrants.

FIG. 20 is a plan elevational view of a completed Reflected Wavy pattern [2000] and the reflected wavy coding chart [2010]. Rotational patterned positions A [510], B [520], C [530] and D [540] complete the entirety of the reflected wavy coding chart [2010]. The patterned orthant coding descriptor [730], similar to that shown in FIG. 7, for the reflected wavy coding chart [2010] reads as follows; QI-L1-RA: QI-L2-RB: QI-L3-RD: QI-L4-RC; QIII-L1-R*: QIII-L2-RB: QIII-L3-RA: QIII-L4-RC; QIV-L1-RD. Coding for Quadrants II [704] and IV [708] correspond to the coding for Quadrants I [702] and III [706], respectively.

FIG. 21 is a plan elevational view of a completed Alternating Inverted Wavy pattern [2100] and the alternating inverted wavy coding chart [2110]. Alternating rotational patterned position B [520] and rotational patterned position D [540] complete the entirety of the alternating inverted wavy coding chart [2110]. The patterned orthant coding descriptor [730], similar to that shown in FIG. 7, for the alternating inverted wavy coding chart [2110] reads as follows; QI-L1-PD: QI-L2-PB: QI-L3-PD: QI-L4-PB with the coding repeated in all subsequent quadrants.

FIG. 22 is a plan elevational view of a completed Swirled Wave pattern [2200] and the swirled wave coding chart [2210]. Rotational patterned positions A [510], B [520], C [530] and D [540] complete the entirety of a swirled wave coding chart [2210]. The individual patterned square locations 3 [724] and 4 [726] of each quadrant [702-708] are skewed in order to complete this pattern, as provided by prime notation [2212]. The patterned orthant coding descriptor [730], similar to that shown in FIG. 7, for the swirled wave coding chart [2210] reads as follows; QI-L1-RA: QI-L2-RB: QI-L3-RC': QI-L4-RD'; QIII-L1-RB: QIII-L2-RA: QIII-L3-RD': QIII-L4-RC'. Coding for Quadrants II [704] and IV [708] correspond to the coding for Quadrants I [702] and III [706], respectively.

FIG. 23 is a plan elevational view of a completed Stacked Wheel pattern [2300] and the stacked wheel coding chart [2310]. Rotational patterned positions A [510], B [520], C [530] and D [540] complete the entirety of the stacked wheel coding chart [2310]. The patterned orthant coding descriptor [730], similar to that shown in FIG. 7, for the stacked wheel coding chart [2310] reads as follows; QI-L1-RB: QI-L2-RA: QI-L3-RD: QI-L4-RA; QII-L1-RB: QII-L2-RC: QII-L3-RB:

QII-L4-RA; QIII-L1-RB: QIII-L2-RC: QIII-L3-RD: QIII-L4-RC; QIV-L1-RD: QIV-L2-RC: QIV-L3-RD: QIV-L4-RA.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of forming multiple inlaid patterns to complete a final predetermined rotational pattern onto or into a pavement surface comprising:

(a) a template for creating multiple blocks with portions of rotational isometric patterns;

(b) impressing said template into said pavement surface when said surface is in a pliable state to form an impression therein;

(c) removing said template from said surface to expose said impression;

(d) providing an inlaid rotatable preform grid that at least partially matches the pattern of said template;

(e) inserting said rotatable preform grid into said impression caused by said template;

(f) fixing said rotatable preform grid in position within said impression to form said inlaid pattern;

thereby;

(g) creating multiple blocks of said portions of said patterns such that rotational isometric patterns form a final rotational predetermined isometric patterned preform, wherein said final rotational predetermined isomeric patterned preform is formed using patterned orthant coding descriptors describing quadrants designated as (Q#), individual pattern square locations designated as (L#), and rotational pattern positions designated as (R*), where # represents the corresponding location or quadrant number and * represents the corresponding letter associated with each angular rotational positional expressed in degrees from a vertical y-axis.

2. The method of forming an inlaid pattern of claim 1, wherein after the preceding step (f), fixing said grid in position within impressions for forming said inlaid patterns is accomplished by passing a portable heater over the surface of said grid.

3. The method of claim 1, wherein said pavement surface is asphalt.

4. The method of claim 3, further comprising the step of heating said asphalt surface prior to impressing said template into the asphalt surface.

5. The method of claim 1, wherein the step of fixing said grid in position within said impression comprises heating said grid after insertion of said grid into said impression to cause said grid to bond to said pavement surface.

6. The method of claim 5, wherein said grid is heated to a temperature within the range of approximately 100 to 400 degrees Fahrenheit.

7. The method of claim 5, wherein said grid is heated to a temperature within the range of approximately 150 to 350 degrees Fahrenheit.

8. The method of claim 1, wherein said grid comprises a pre-formed thermoplastic pattern.

9. The method of claim 1, wherein said grid is of unitary construction.

10. The method of claim 1, wherein said grid has a color contrasting with the color of said pavement surface.

11. The method of claim 1, wherein said grid comprises retroflective elements including glass heads and skid resistant elements that provide said template retroflective capabilities after said template is fixed in position within said impression.

12. The method of claim 11, wherein said grid is luminescent.

13. The method of claim 11, wherein said grid is fluorescent.

14. The method of claim 1, wherein said grid comprises an upper surface, wherein said upper surface is substantially flush with the surface of said pavement surface when said grid is fixed in position.

15. The method of claim 1, wherein said grid comprises an upper surface, wherein said upper surface is recessed below the surface of the pavement when said grid is in a fixed position.

16. The method of claim 15, wherein said grid comprises an upper surface, wherein said upper surface projects above the surface of said pavement when said grid is in a fixed position.

17. The method of claim 1, wherein said grid is a preform with a plurality of frame elements prior to inserting said grid into said impression, and wherein the preform frame elements have a width less than 12 inches.

18. The method of claim 17, wherein said frame elements have a width between ¼ inch and 4 inches.

19. The method of claim 1, wherein said predetermined pattern is decorative.

20. The method of claim 1, wherein said predetermined pattern is non-linear.

21. The method of claim 6, wherein said heating comprises passing a portable surface heater over a upper surface of said grid after said grid has been inserted into said impression.

22. An article of manufacture comprising; a grid and/or a template for creating multiple blocks of portions of rotational isometric patterned preforms wherein said grid and/or template provides a final rotational predetermined isometric patterned preform based on properly positioning said multiple blocks wherein said positioning of said final rotational predetermined isometric patterned preform is formed using patternted orthant coding descriptors describing quadrants designated as (Q#), individual patterned square locations designated as (L#), and rotational patterned positions designated as (R*), where # represents the corresponding location or quadrant number and * represents the corresponding letter associated with each angular rotational position expressed in degrees from a vertical v-axis.

23. The article of claim 22, wherein said grid and/or template is a rotationally patterned thermoplastic perform.

24. The article of claim 22, wherein said grid and/or template is formed from a plastic material.

25. The article of claim 22, wherein said grid and/or template is formed from a thermoplastic material.

26. The article of claim 22, wherein said grid and/or template is formed from rubber.

27. The method article of claim 22, wherein said template is a preform with a plurality of frame elements prior to inserting said grid into said impression, and wherein the preform frame elements have a width less than 12 inches.

28. The article of claim 27, wherein said frame elements have a width between ¼ inch and 4 inches.

29. The article of claim 27, wherein said frame elements have a width between ⅜ inch and 2 inches.

30. The article of claim 27, wherein the thickness of said grid is between 80 and 100 mil.

31. The article of claim 27, wherein the thickness of said template is between 125 and 200 mil.

32. The article of claim 22, wherein said grid comprises a unitary grid of frame elements.

33. The article of claim 22 further comprising the step of pre-heating the asphalt surface after forming the impression.

34. The article of claim 22 further comprising the step of pre-heating the asphalt surface by using a portable heater prior to the impressing step.

* * * * *